US010767656B2

(12) United States Patent
Hamada et al.

(10) Patent No.: US 10,767,656 B2
(45) Date of Patent: Sep. 8, 2020

(54) AXIAL FLOW FAN AND AIR-CONDITIONING APPARATUS HAVING AXIAL FLOW FAN

(71) Applicant: Mitsubishi Electric Corporation, Tokyo (JP)

(72) Inventors: Shingo Hamada, Tokyo (JP); Koji Sachimoto, Tokyo (JP); Yosuke Kikuchi, Tokyo (JP); Hajime Ikeda, Tokyo (JP); Takashi Kobayashi, Tokyo (JP); Seiji Hirakawa, Tokyo (JP); Hiroshi Yoshikawa, Tokyo (JP); Hidetomo Nakagawa, Tokyo (JP); Hiroaki Makino, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 414 days.

(21) Appl. No.: 15/311,873

(22) PCT Filed: Aug. 3, 2015

(86) PCT No.: PCT/JP2015/071968
§ 371 (c)(1),
(2) Date: Nov. 17, 2016

(87) PCT Pub. No.: WO2016/021555
PCT Pub. Date: Feb. 11, 2016

(65) Prior Publication Data

US 2018/0003190 A1 Jan. 4, 2018

(30) Foreign Application Priority Data

Aug. 7, 2014 (JP) ..... 2014-161651

(51) Int. Cl.
*F04D 29/32* (2006.01)
*F04D 29/38* (2006.01)
*F04D 29/34* (2006.01)

(52) U.S. Cl.
CPC ..... *F04D 29/329* (2013.01); *F04D 29/34* (2013.01); *F04D 29/38* (2013.01); *F04D 29/384* (2013.01); *F04D 29/388* (2013.01)

(58) Field of Classification Search
CPC ..... F04D 29/329; F04D 29/34; F04D 29/38; F04D 29/384; F04D 29/388; F04D 29/325
(Continued)

(56) References Cited

U.S. PATENT DOCUMENTS 713,990 A * 11/1902 Keith ..... F04D 29/281 416/175
872,307 A * 11/1907 Sargent ..... F04D 29/666 416/203
(Continued)

FOREIGN PATENT DOCUMENTS

CN 103790859 A 5/2014
DE 102009041616 A1 * 3/2011 ..... F04D 25/022
(Continued)

OTHER PUBLICATIONS

Office Action dated Jun. 1, 2018 issued in corresponding CN patent application No. 201580028957.X (and English translation).
(Continued)

*Primary Examiner* — Richard A Edgar
*Assistant Examiner* — Maranatha Boardman
(74) *Attorney, Agent, or Firm* — Posz Law Group, PLC

(57) ABSTRACT

In an axial flow fan according to the present invention, a plurality of blades rotate about a rotation axis of the blades to convey a fluid. In the axial flow fan, the plurality of blades
(Continued)

each have a leading edge at a leading side in a rotational direction, a trailing edge at a trailing side in the rotational direction, and an outer peripheral edge connecting the leading edge and the trailing edge. The leading edge of one of the plurality of blades and the trailing edge of another blade adjacent to the leading edge of the blade in the rotational direction are connected by a plate-shaped connection portion. The plurality of blades each have at least one plate-shaped reinforcement rib extending from a periphery of the rotation axis toward the outer peripheral edge of the blade.

12 Claims, 30 Drawing Sheets

(58) Field of Classification Search
USPC ..... 416/175, 203, 241 A
See application file for complete search history.

(56) References Cited

U.S. PATENT DOCUMENTS 1,519,102 A * 12/1924 Assala ..... B64C 11/00 416/175
1,738,210 A * 12/1929 Sargent ..... B64C 11/006 415/143
2,262,695 A * 11/1941 Moeller ..... F04D 25/082 310/60 R
2,620,970 A * 12/1952 Palmer ..... F04D 29/646 416/175
2,697,589 A * 12/1954 Kingsley ..... B01F 7/00275 416/203
2,978,040 A * 4/1961 Wirkkala ..... B63H 1/20 416/228
3,033,049 A * 5/1962 Morrow ..... F04D 25/02 416/170 R
3,071,315 A * 1/1963 Alis ..... D05B 81/00 416/236 R
3,885,888 A * 5/1975 Warhol ..... F04D 29/329 416/175
4,172,691 A * 10/1979 Comstock ..... F04D 29/388 416/132 A
4,671,739 A 6/1987 Read et al.
4,721,394 A * 1/1988 Casto ..... B01F 7/00341 366/330.2
5,066,196 A * 11/1991 Morofushi ..... F04D 29/325 416/234
5,437,541 A 8/1995 Vainrub
5,454,695 A * 10/1995 Shah ..... F04D 25/166 416/169 A
6,065,936 A * 5/2000 Shingai ..... B29C 45/33 416/132 R
6,565,320 B1 * 5/2003 Surls ..... F04D 29/329 416/175
6,655,929 B2 * 12/2003 Hsieh ..... F04D 25/082 415/176
7,121,798 B2 * 10/2006 Braun ..... F04D 29/30 416/185
7,201,565 B2 * 4/2007 Ku ..... F04D 29/329 416/175
8,257,023 B2 * 9/2012 Belmonte ..... F01D 5/146 415/83
9,033,674 B2 * 5/2015 Jang ..... F01D 5/147 416/234
9,217,443 B2 * 12/2015 He ..... F04D 29/329
9,447,791 B2 * 9/2016 Aschermann ..... F04D 29/384
9,605,686 B2 * 3/2017 Hamada ..... F04D 29/384
2014/0119938 A1 5/2014 Jang et al.
2014/0341748 A1 * 11/2014 Kojima ..... F04D 29/023 416/234
2018/0003190 A1 * 1/2018 Hamada ..... F04D 29/34

FOREIGN PATENT DOCUMENTS

EP 1 795 761 A1 6/2007
EP 2 525 061 A1 11/2012
JP 28-12352 Y1 12/1953
JP S53-90009 A 8/1978
JP S54-034108 A 3/1979
JP S62-133996 U 8/1987
JP H05-280494 A 10/1993
JP H06-67893 U 9/1994
JP H08-178337 A 7/1996
JP 2003-531341 A 10/2003
JP 2004-132211 A 4/2004
JP 2005-105865 A 4/2005
JP 2010-101223 A 5/2010
JP 2010-255513 A 11/2010
JP 2013-517406 A 5/2013

OTHER PUBLICATIONS

Office Action dated Jun. 22, 2017 issued in corresponding AU patent application No. 2015300206.
International Search Report of the International Searching Authority dated Oct. 6, 2015 for the corresponding international application No. PCT/JP2015/071968 (and English translation).
Extended European Search Report dated May 19, 2017 issued in corresponding EP patent application No. 15829250.8.
Office Action dated May 23, 2017 issued in corresponding JP patent application No. 2016-540221 (and English translation).
Extended European Search Report dated Mar. 14, 2018 issued in corresponding EP patent application No. 17200518.3.
Examination Report dated Oct. 10, 2019 issued in corresponding IN patent application No. 201747005640 (and English translation).
Office Action dated Nov. 26, 2019 issued in corresponding JP patent application No. 2019-006031 (and English translation).
Office Action dated Feb. 25, 2020 issued in corresponding JP application No. 2019-006031(with English translation).
Office Action dated Feb. 28, 2020 issued in corresponding EP patent application No. 17 200 518.3.

* cited by examiner

AXIAL FLOW FAN AND AIR-CONDITIONING APPARATUS HAVING AXIAL FLOW FAN

CROSS REFERENCE TO RELATED APPLICATIONS

This application is a U.S. national stage application of PCT/JP2015/071968 filed on Aug. 3, 2015, which claims priority to Japanese Patent Application No. 2014-161651 filed on Aug. 7, 2014, the contents of which are incorporated herein by reference.

TECHNICAL FIELD

The present invention relates to an axial flow fan equipped with a plurality of blades, and to an air-conditioning apparatus having such an axial flow fan.

BACKGROUND ART

FIGS. 20 to 23 schematically illustrate an axial flow fan in the related art.

FIG. 20 is a perspective view of a boss-equipped axial flow fan in the related art.

FIG. 21 is a front view of the boss-equipped axial flow fan in the related art, as viewed from upstream in a fluid flowing direction.

FIG. 22 is a front view of the boss-equipped axial flow fan in the related art, as viewed from downstream in the fluid flowing direction.

FIG. 23 is a side view of the boss-equipped axial flow fan in the related art, as viewed from a lateral side relative to a rotation axis.

As shown in FIGS. 20 to 23, the axial flow fan in the related art includes a plurality of blades 1 along the peripheral surface of a cylindrical boss. When a rotational force is applied to the boss, the blades 1 rotate in a rotational direction 11 to convey a fluid in a fluid flowing direction 10. Such a configuration is also disclosed in, for example, Patent Literature 1. In the axial flow fan, the blades 1 rotate to cause the fluid existing between the blades to collide against the blade surfaces. The surfaces against which the fluid collides increase in pressure and press and move the fluid in the direction of a rotation axis serving as a central axis when the blades 1 rotate.

In terms of the shape of an axial flow fan, a so-called boss-less fan not having a cylindrical boss is also known (see Patent Literature 2). In a boss-less fan, leading edges and trailing edges of neighboring blades among a plurality of blades 1 are connected by a continuous surface without the intervention of a boss, and the boss-less fan is provided with a small-diameter cylindrical portion at the center thereof for securing a drive shaft of a motor thereto. Thus, the minimum radius of the continuous surface between the blades centered on a rotation axis is larger than the radius of the cylindrical portion for securing the drive shaft thereto.

CITATION LIST

Patent Literature

Patent Literature 1: Japanese Unexamined Patent Application Publication No. 2005-105865

Patent Literature 2: Japanese Unexamined Patent Application Publication No. 2010-101223

SUMMARY OF INVENTION

Technical Problem

In the boss-equipped axial flow fan in the related art, it is difficult to achieve weight reduction due to the increased weight of the boss, thus making it difficult to save resources (i.e., to reduce the load on the environment). In addition, since the boss does not have an air-blowing function, there is a problem in that it is difficult to improve the air-blowing efficiency of the fan.

In contrast, in the so-called boss-less fan, the aforementioned problem is minimized due to the absence of a boss. However, due to insufficient strength, the blades deform by a large amount when a centrifugal force generated by rotation is applied to the blades. This is problematic in that the air-blowing performance deteriorates due to an inability to maintain the shape of the blades or in that the blades may break due to the centrifugal force when the propeller rotates at high speed in response to strong wind during, for example, a typhoon. If the strength is ensured by increasing the thickness near the rotation axis, the advantage of weight reduction, which is the advantage of the boss-less type, is lost.

The present invention has been made to solve the problems of the axial flow fan described above, and an object thereof is to reduce the weight of an axial flow fan by eliminating a boss while maintaining the strength of the blades, and also to improve the air-blowing efficiency.

Solution to Problem

An axial flow fan according an embodiment of the present invention, includes a plurality of blades and being configured to rotate about a rotation axis of the blades to convey a fluid, the plurality of blades each having a leading edge at a leading side in a rotational direction, a trailing edge at a trailing side in the rotational direction, and an outer peripheral edge connecting the leading edge and the trailing edge, the leading edge of one of the plurality of blades and the trailing edge of another blade adjacent to the leading edge of the blade in the rotational direction being connected by a plate-shaped connection portion, the plurality of blades each having at least one plate-shaped reinforcement rib extending from a periphery of the rotation axis toward the outer peripheral edge of the blade.

Advantageous Advantages of Invention

With the axial flow fan according the embodiment of the present invention, the weight of the axial flow fan is reduced by eliminating a boss and the strength of the blades is maintained. In addition, the air-blowing function by the reinforcement ribs is added so that the air-blowing efficiency can be improved.

A "propeller fan" in the following description is described as an example of an "axial flow fan".

DESCRIPTION OF EMBODIMENTS

Embodiment 1

The structure of a propeller fan according to Embodiment 1 will be described with reference to FIGS. 1 to 5.

Figure 1:
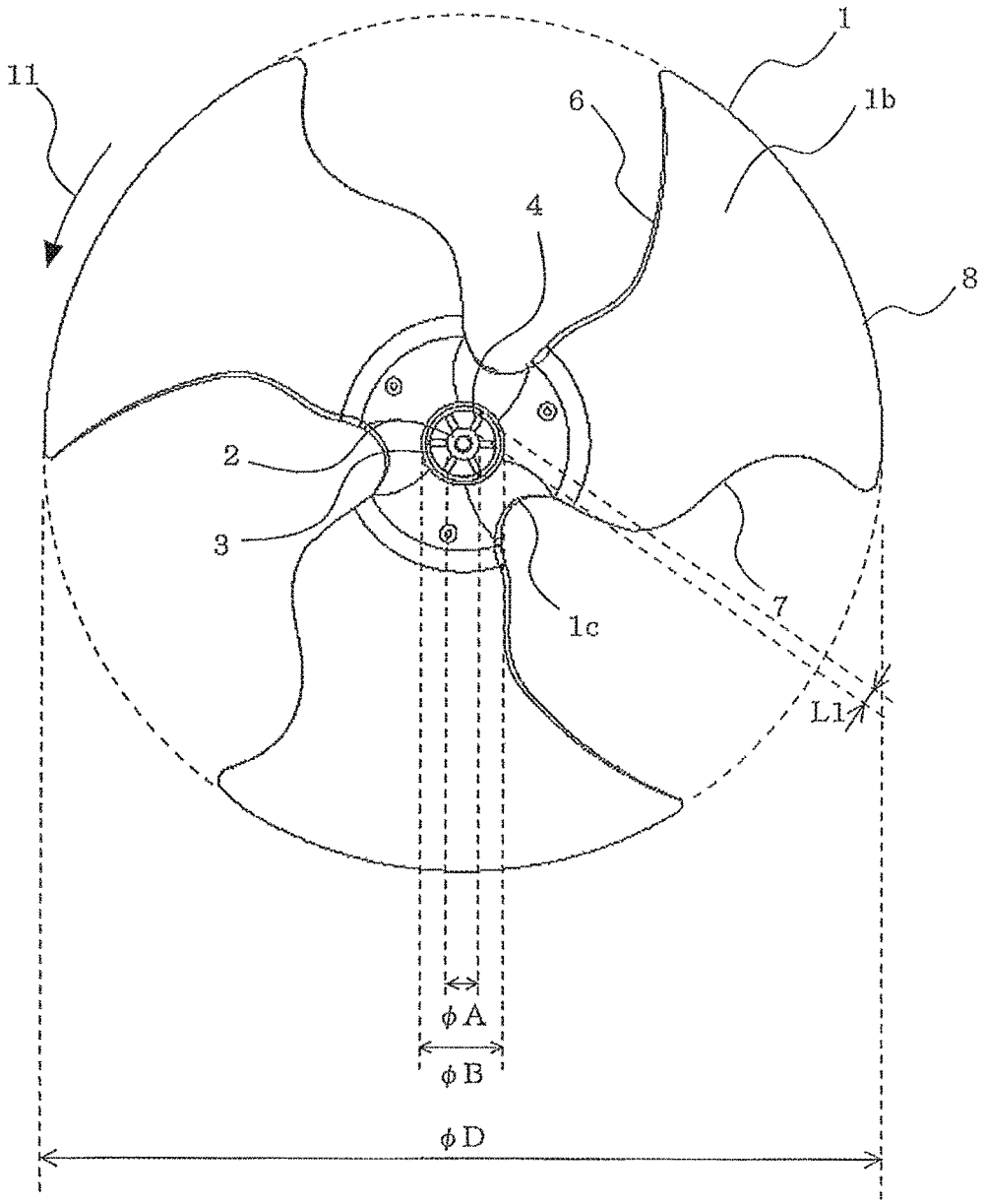
FIG. 1 is a front view of a propeller fan according to Embodiment 1, as viewed from upstream in a fluid flowing direction.

FIG. 1 is a front view of the propeller fan according to Embodiment 1, as viewed from upstream in a fluid flowing direction.

Figure 2:
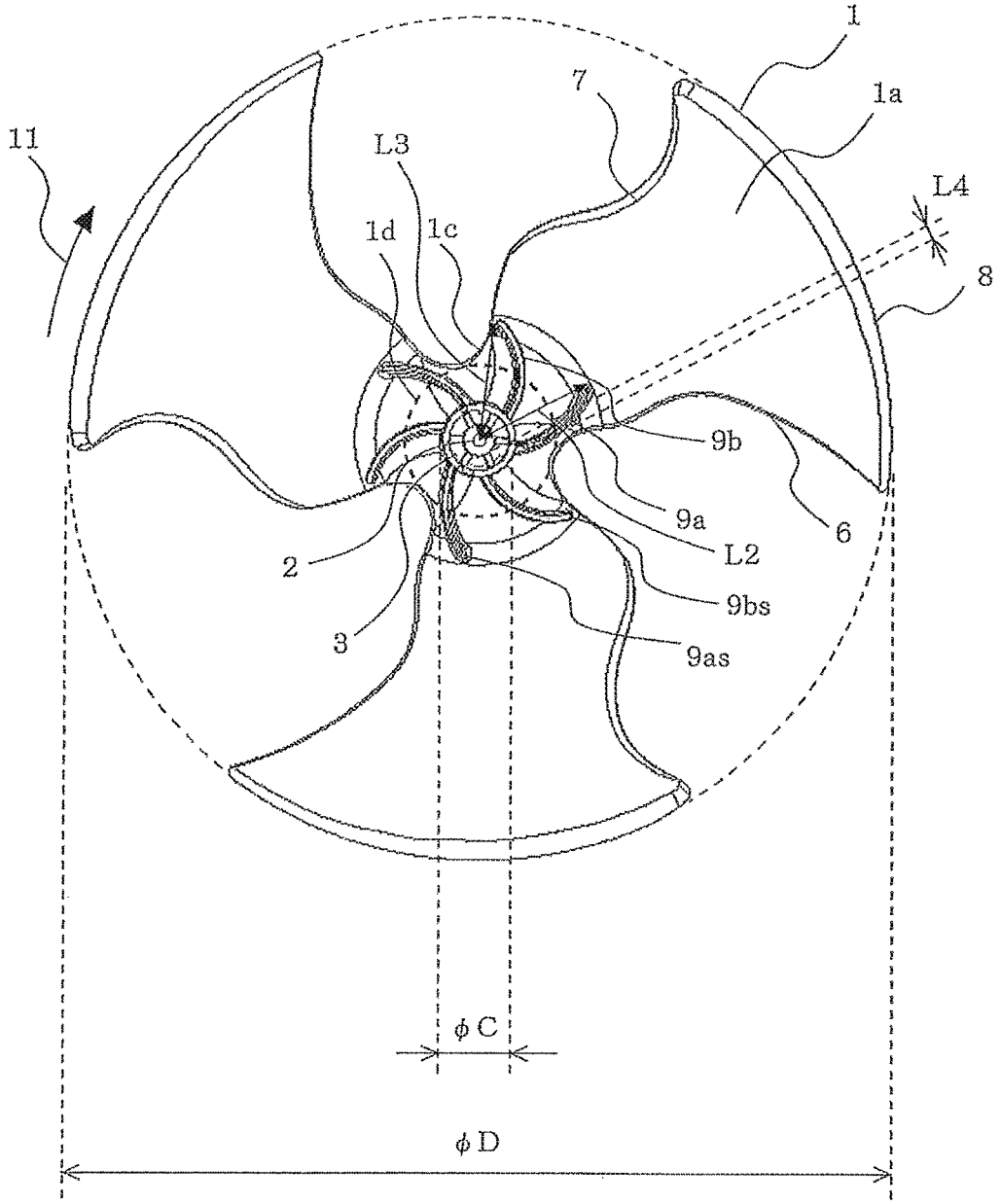
FIG. 2 is a front view of the propeller fan according to Embodiment 1, as viewed from downstream in the fluid flowing direction.

FIG. 2 is a front view of the propeller fan according to Embodiment 1, as viewed from downstream in the fluid flowing direction.

Figure 3:
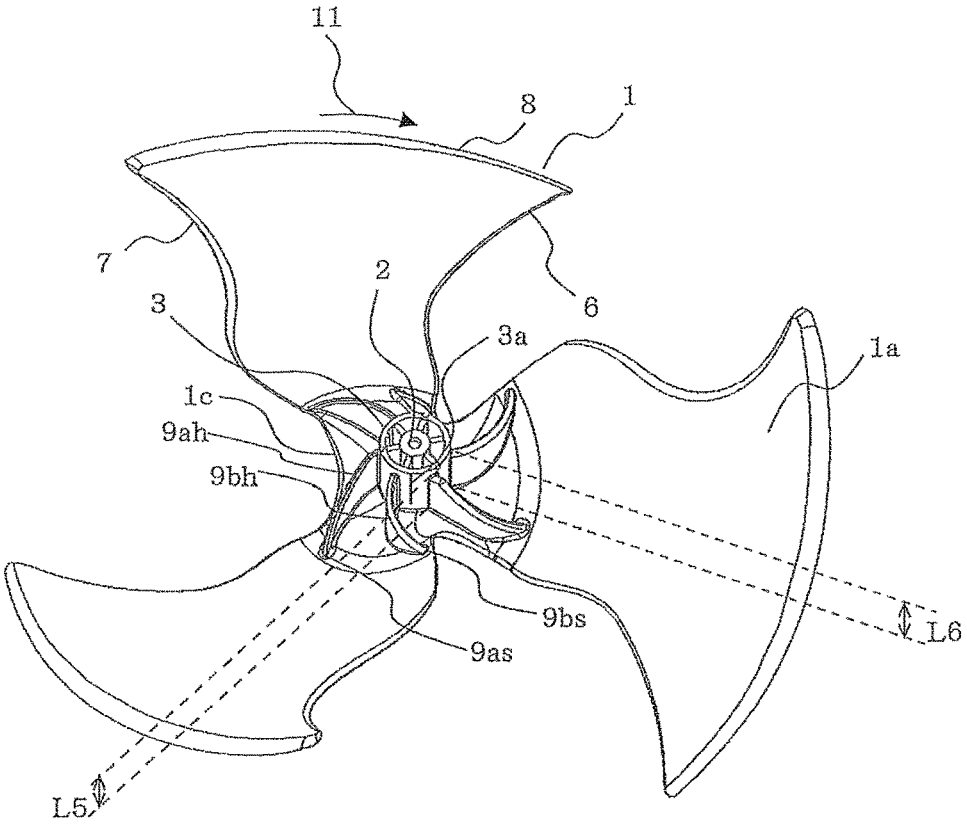
FIG. 3 is a perspective view of the propeller fan according to Embodiment 1, as viewed from downstream in the fluid flowing direction.

FIG. 3 is a perspective view of the propeller fan according to Embodiment 1, as viewed from downstream in the fluid flowing direction.

Figure 4:
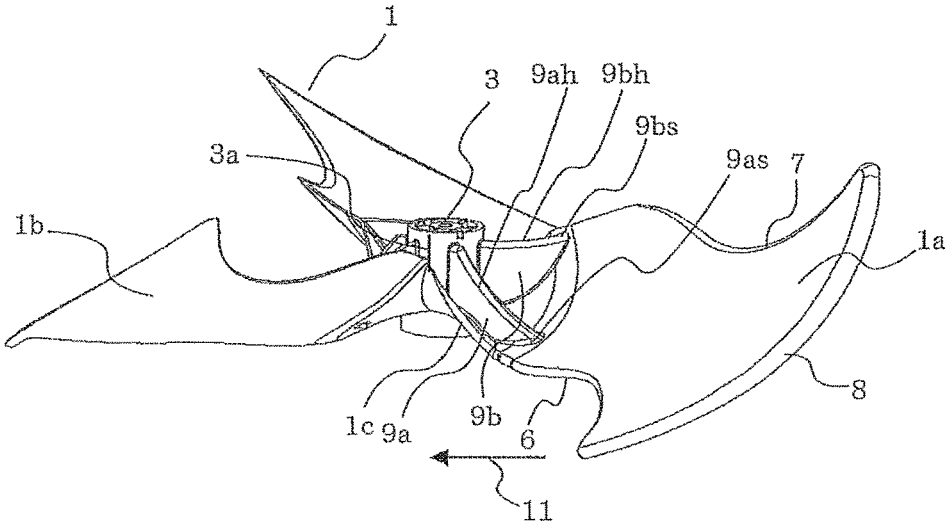
FIG. 4 is a perspective view of the propeller fan according to Embodiment 1, as viewed from a lateral side relative to the fluid flowing direction.

FIG. 4 is a perspective view of the propeller fan according to Embodiment 1, as viewed from a lateral side relative to the fluid flowing direction.

Figure 5:
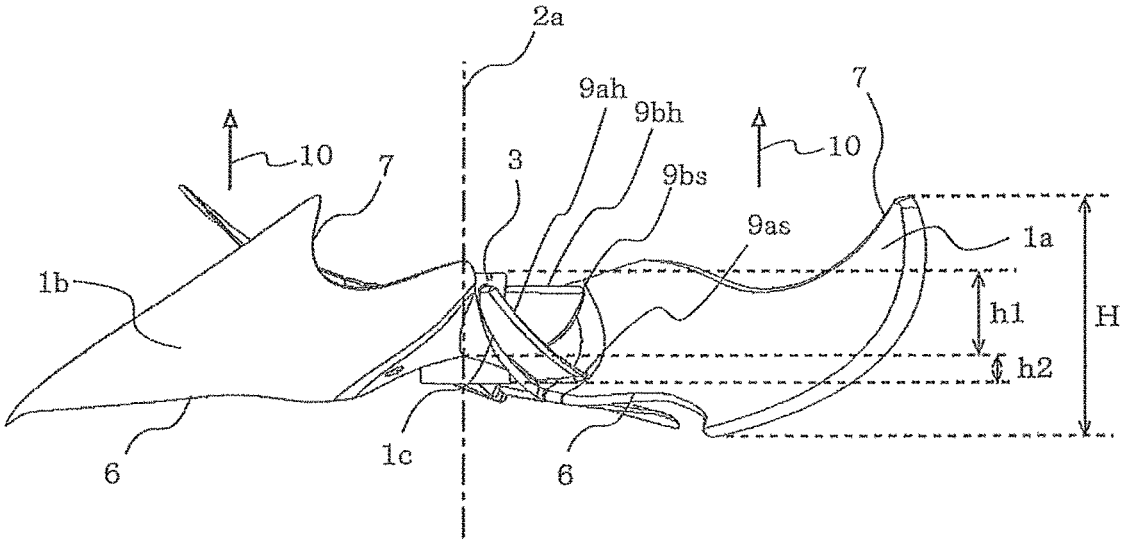
FIG. 5 is a side view of the propeller fan according to Embodiment 1, as viewed from a lateral side relative to the fluid flowing direction.

FIG. 5 is a side view of the propeller fan according to Embodiment 1, as viewed from a lateral side relative to the fluid flowing direction.

Figure 6:
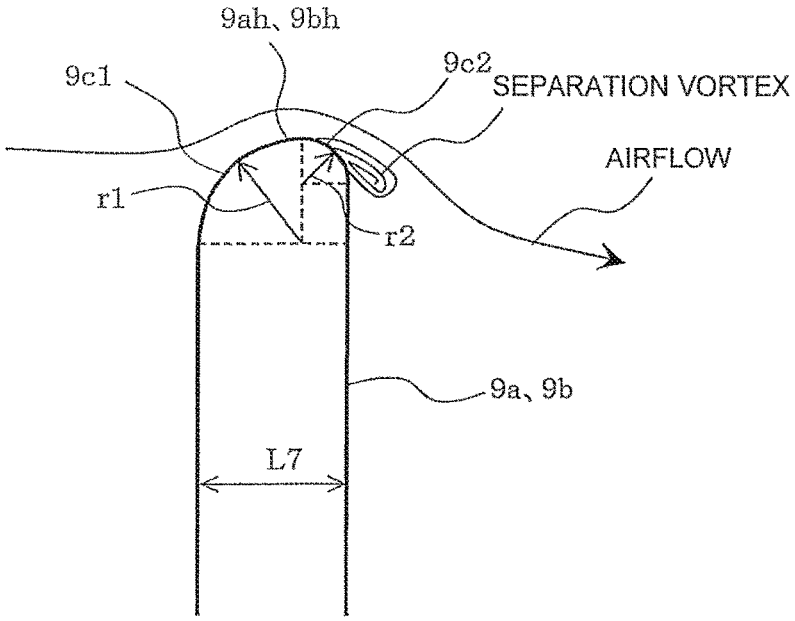
FIG. 6 is a cross-sectional view of a reinforcement rib of the propeller fan according to Embodiment 1.

FIG. 6 is a cross-sectional view of a reinforcement rib of the propeller fan according to Embodiment 1.

Figure 7:
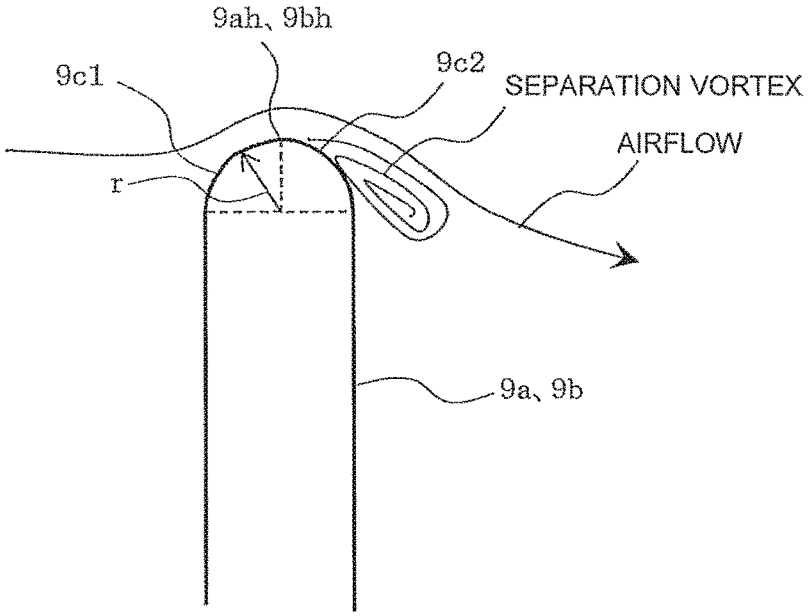
FIG. 7 is a comparative cross-sectional view of the reinforcement rib of the propeller fan according to Embodiment 1.

FIG. 7 is a comparative cross-sectional view of the reinforcement rib of the propeller fan according to Embodiment 1.

<Overall Configuration of Propeller Fan>

The propeller fan according to Embodiment 1 rotates about a rotation axis 2*a* serving as a central axis. In the propeller fan, a cylindrical shaft hole 2 that engages with a drive shaft of a motor and a cylindrical portion 3 that supports the shaft hole 2 are provided around the rotation axis 2*a*, and a plurality of blades 1 are fixed to the outer wall surface of the cylindrical portion 3. A plurality of connection ribs 4 are provided between the shaft hole 2 and the cylindrical portion 3.

The propeller fan is composed of, for example, resin and is formed by, for example, injection molding. The resin used for the propeller fan is, for example, a material given increased strength by mixing glass-reinforced fibers and mica in polypropylene. Thus, since it is not easy to separate polypropylene resin alone from a material mixed with microscopic glass or rocks and such a material is difficult to recycle, it is desirable to reduce the amount of material used as much as possible to save resources.

The blades 1 are inclined at a predetermined angle relative to the rotation axis 2*a* serving as the central axis when the propeller fan rotates, and conveys a fluid existing between the blades in a fluid flowing direction 10 by pressing against the fluid with the blade surfaces as the propeller fan rotates. Each blade surface includes a pressure surface 1*a*, at which the pressure increases as a result of pressing against the fluid, and a suction surface 1*b* that is located at the reverse side of the pressure surface 1*a* and at which the pressure decreases.

Each blade 1 has a shape defined by a leading edge 6 at the leading side in a rotational direction 11 of the blade 1, a trailing edge 7 at the trailing side in the rotational direction 11 of the blade 1, and an outer peripheral edge 8 at the outer periphery of the blade 1.

As shown in FIGS. 1 and 2, the plurality of blades 1 surrounding the cylindrical portion 3 are smoothly connected by a connection portion 1*c* that connects the leading edges 6 and the trailing edges 7 of the blades 1. A circular minimum radius portion 1*d* indicated by a dashed line and having a radius defined by the shortest distance between the rotation axis 2*a* and the peripheral edge of the connection portion 1*c* is provided. Specifically, the minimum radius portion 1*d* having a radius defined by the shortest distance between the rotation axis 2*a* and the peripheral edge of the connection portion 1*c* is provided around the rotation axis 2*a*, and the cylindrical portion 3 defined with the rotation axis 2*a* as the central axis and having an outer radius smaller than the radius of the minimum radius portion 1*d* is provided in the minimum radius portion 1*d*.

Thus, the radius of the minimum radius portion 1*d* centered on the rotation axis 2*a* is larger than the outer radius of the cylindrical portion 3. A propeller fan having this shape is a so-called boss-less fan.

As shown in FIG. 5 in particular, the connection portion 1*c* is inclined from the leading edge 6 of the neighboring blade 1 toward the trailing edge 7 of the blade 1 in the fluid flowing direction 10 that is parallel to the rotation axis 2*a*.

As shown in FIG. 5, in the cylindrical portion 3, a length h1 at the pressure surface 1*a* of each blade 1, which is on the downstream side in the fluid flowing direction 10, is larger than a length h2 at the suction surface 1*b*. Moreover, reinforcement ribs 9 are provided between the outer wall surface of the cylindrical portion 3 and the pressure surfaces 1*a* of the blades 1.

<Configuration of Reinforcement Ribs 9>

The reinforcement ribs 9 are, for example, plate-like members standing parallel to the rotation axis 2*a* on the pressure surfaces 1*a* of the blades 1. The reinforcement ribs 9 connect the outer peripheral surface of the cylindrical portion 3 to the plurality of blades 1. When viewed from the front in the direction of the rotation axis 2*a*, each reinforcement rib 9 has a curved shape (i.e., turbo blade shape) convex toward the leading edge 6 of the propeller fan, as shown in FIG. 2.

For example, two reinforcement ribs 9 (i.e., an upstream rib 9*a* and a downstream rib 9*b*) are disposed for each blade 1. The upstream rib 9*a* is disposed at the leading side in the rotational direction 11 of the propeller fan, whereas the downstream rib 9*b* is disposed at the trailing side in the rotational direction 11 of the propeller fan.

The upstream rib 9*a* and the downstream rib 9*b* respectively have upper edges 9*ah* and 9*bh* at their ends facing the connection areas with the blade 1. As shown in FIG. 5, the upstream rib 9*a* and the downstream rib 9*b* are shaped such that the upper edge 9*ah* of the upstream rib 9*a* is inclined relative to the direction of the rotation axis 2*a* and the upper edge 9*bh* of the downstream rib 9*b* is substantially orthogonal to the direction of the rotation axis 2*a* of the shaft hole 2. The upper edge 9*ah* of the upstream rib 9*a* is inclined to extend upstream in the fluid flowing direction 10 as it extends toward the outer periphery of the propeller fan.

An upstream-rib contact point 9*as* serving as a contact point between the upper edge 9*ah* of the upstream rib 9*a* and the pressure surface 1*a* of the blade 1 and a downstream-rib contact point 9*bs* serving as a contact point between the upper edge 9*bh* of the downstream rib 9*b* and the pressure surface 1*a* of the blade 1 are substantially concentrically disposed with respect to the rotation axis 2*a*.

Furthermore, the upstream-rib contact point 9*as* and the downstream-rib contact point 9*bs* are disposed near the leading edge 6 of the blade 1 and near the trailing edge 7 of the blade 1, respectively, to support the blade 1.

Moreover, the upstream-rib contact point 9*as* is located upstream of the downstream-rib contact point 9*bs* in the fluid flowing direction 10.

Furthermore, an intersection point between the outer peripheral surface of the cylindrical portion 3 and the upper edge 9*ah* of the upstream rib 9*a* is located at the same position, in the direction of the rotation axis 2*a*, as an intersection point between the outer peripheral surface of the cylindrical portion 3 and the upper edge 9*bh* of the downstream rib 9*b*.

<Cross-Sectional Shape of Reinforcement Ribs 9>

As shown in FIG. 6, the upper edge 9*ah* of the upstream rib 9*a* and the upper edge 9*bh* of the downstream rib 9*b* each have a cross-sectional shape defined by two circular arcs, that is, a first circular arc 9*c*1 and a second circular arc 9*c*2, at the leading-edge side and the trailing-edge side, respectively, of the propeller fan in the rotational direction 11.

A cross-sectional radius r1 of the first circular arc 9*c*1 at the leading-edge side is set to be larger than a cross-sectional radius r2 of the second circular arc 9*c*2 at the trailing-edge side.

As a comparison with FIG. 6, FIG. 7 illustrates the flow of an air current in a case where the first circular arc 9*c*1 and the second circular arc 9*c*2 have the same cross-sectional radius r.

A drive shaft having a D-shaped cross section is to be fitted and secured to the shaft hole 2, and an indicator 3*a* indicating the position of a horizontal portion of the D-cut drive shaft and having a protruding shape or a recessed shape is provided between the blades 1 at the outer wall surface of the cylindrical portion 3.

<Dimensions of Components of Propeller Fan>

Assuming that the maximum outer diameter of each blade 1 of the propeller fan is defined as ϕD and the outer diameter of the shaft hole 2 is defined as ϕA in FIG. 1, it is preferable that ϕA be set such that the value of ϕA/ϕD is between 0.02 and 0.05 inclusive.

Furthermore, assuming that the maximum outer diameter of each blade 1 of the propeller fan is defined as ϕD and the outer diameter of the cylindrical portion 3 is defined as ϕB in FIG. 1, it is preferable that ϕB be set such that the value of ϕB/ϕD is between 0.05 and 0.15 inclusive.

Moreover, assuming that the maximum outer diameter of each blade 1 of the propeller fan is defined as ϕD and the length of each connection rib 4 (i.e., the length between the outer peripheral surface of the shaft hole 2 and the inner peripheral surface of the cylindrical portion 3) is defined as L1 in FIG. 1, it is preferable that L1 be set such that the value of L1/ϕD is between 0.01 and 0.05 inclusive.

By setting the length L1 of each connection rib 4 to this dimension, the resin material constituting the connection rib 4 can exhibit a vibration attenuation effect for reducing electromagnetic vibration of the drive shaft of the motor.

Assuming that the maximum outer diameter of each blade 1 of the propeller fan is defined as ϕD and the outer diameter of the cylindrical portion 3 is defined as ϕC in FIG. 2, it is preferable that ϕC be set such that the value of ϕC/ϕD is between 0.05 and 0.15 inclusive.

Moreover, assuming that the maximum outer diameter of each blade 1 of the propeller fan is defined as ϕD and the length of the upstream rib 9*a* in the radial direction (i.e., the length between the rotation axis 2*a* and the upstream-rib contact point 9*as*) is defined as L2 in FIG. 2, it is preferable that L2 be set such that the value of L2/ϕD is between 0.1 and 0.2 inclusive.

Furthermore, assuming that the maximum outer diameter of each blade 1 of the propeller fan is defined as ϕD and the length of the downstream rib 9*b* in the radial direction (i.e., the length between the rotation axis 2*a* and the downstream-rib contact point 9*bs*) is defined as L3 in FIG. 2, it is preferable that L3 be set such that the value of L3/ϕD is between 0.1 and 0.2 inclusive.

Moreover, assuming that the maximum outer diameter of each blade 1 of the propeller fan is defined as ϕD and the length of each connection rib 4 (i.e., the length between the outer peripheral surface of the shaft hole 2 and the inner peripheral surface of the cylindrical portion 3) is defined as L4 in FIG. 2, it is preferable that L4 be set such that the value of L4/ϕD is between 0.01 and 0.05 inclusive.

By setting the length L4 of each connection rib 4 to this dimension, the resin material constituting the connection rib 4 can exhibit a vibration attenuation effect for reducing electromagnetic vibration of the drive shaft of the motor.

Assuming that the maximum outer diameter of each blade 1 of the propeller fan is defined as ϕD and the length of the upstream rib 9*a* in the direction of the rotation axis 2*a* is defined as L5 in FIG. 3, it is preferable that L5 be set such that the value of L5/ϕD is between 0.05 and 0.15 inclusive.

Furthermore, assuming that the maximum outer diameter of each blade 1 of the propeller fan is defined as ϕD and the length of the downstream rib 9*b* in the direction of the rotation axis 2*a* is defined as L6 in FIG. 3, it is preferable that L5 be set such that the value of L6/ϕD is between 0.05 and 0.15 inclusive.

Assuming that the maximum outer diameter of each blade 1 of the propeller fan is defined as ϕD and the length of the cylindrical portion 3 at the pressure surface 1*a* side is defined as h1 in FIG. 5, it is preferable that h1 be set such that the value of h1/ϕD is between 0.05 and 0.2 inclusive.

Furthermore, assuming that the maximum outer diameter of each blade 1 of the propeller fan is defined as ϕD and the length of the cylindrical portion 3 at the suction surface 1*b* side is defined as h2 in FIG. 5, it is preferable that h2 be set such that the value of h2/ϕD is 0.1 or smaller.

Assuming that the maximum outer diameter of each blade 1 of the propeller fan is defined as ϕD and the thickness of each of the upstream rib 9*a* and the downstream rib 9*b* is defined as L7 in FIG. 6, it is preferable that L7 be set such that the value of L7/ϕD is between 0.0025 and 0.025 inclusive.

<Flow of Air Current>

Next, the flow of an air current when the propeller fan according to Embodiment 1 rotates will be described with reference to FIG. 8 and FIGS. 24 to 26.

Figure 8:
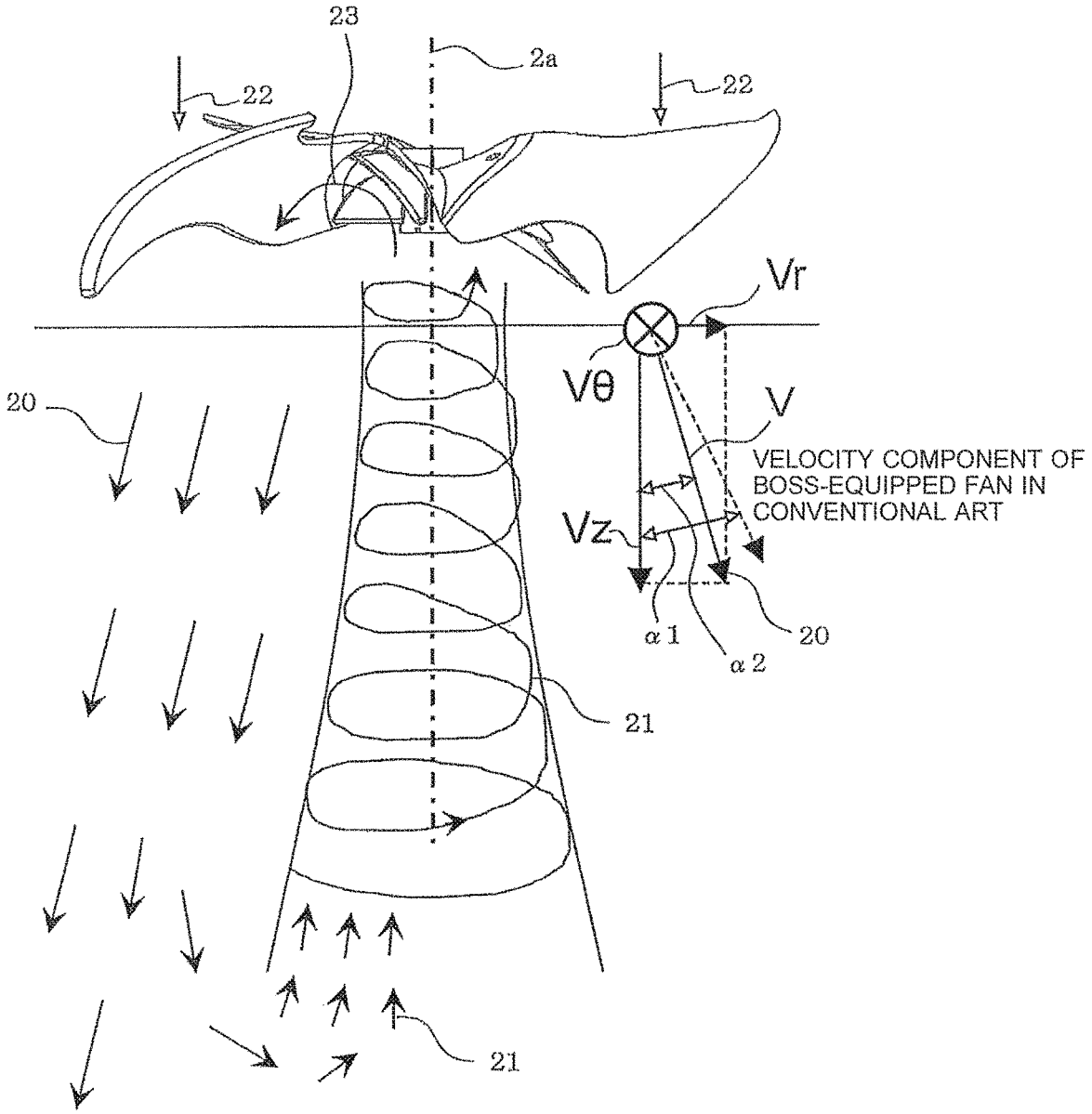
FIG. 8 is a wind-direction diagram in a direction of a rotation axis, illustrating an air current formed by the propeller fan according to Embodiment 1.

FIG. 8 is a wind-direction diagram in the direction of the rotation axis, illustrating an air current formed by the propeller fan according to Embodiment 1.

Figure 24:
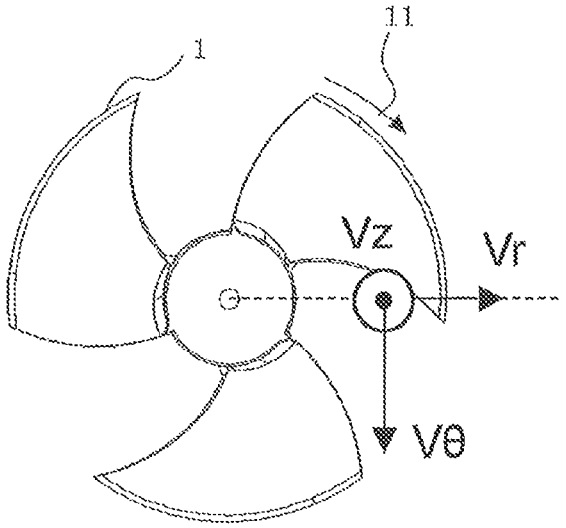
FIG. 24 RELATED ART
FIG. 24 is a front view illustrating velocity components when an air current formed by the boss-equipped propeller fan in the related art is viewed from downstream.

FIG. 24 is a front view illustrating velocity components when an air current formed by a boss-equipped propeller fan in the related art is viewed from downstream.

Figure 25:
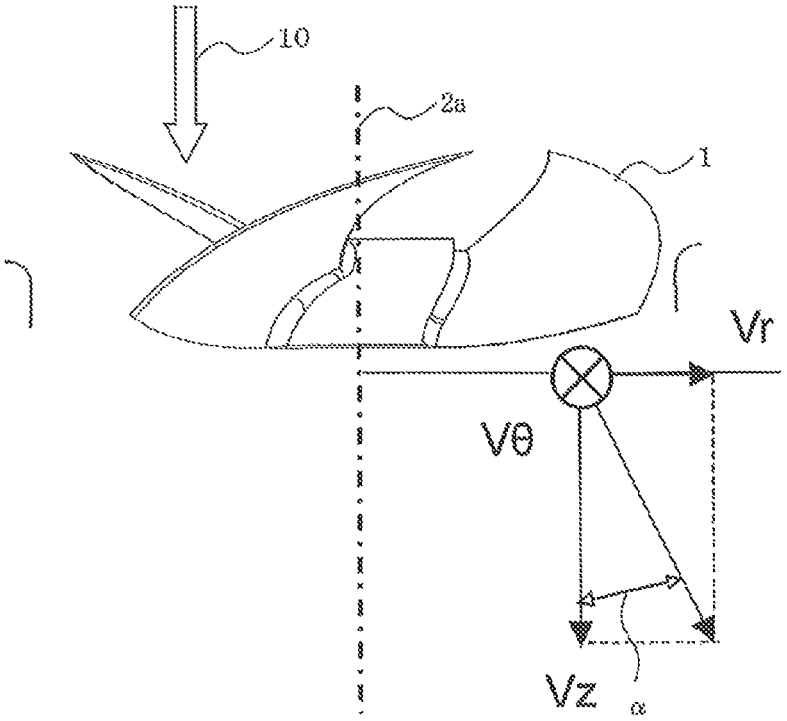
FIG. 25 RELATED ART
FIG. 25 illustrates velocity components, in the direction of the rotation axis, of the air current formed by the boss-equipped propeller fan in the related art.

FIG. 25 illustrates velocity components, in the direction of the rotation axis, of the air current formed by the boss-equipped propeller fan in the related art.

Figure 26:
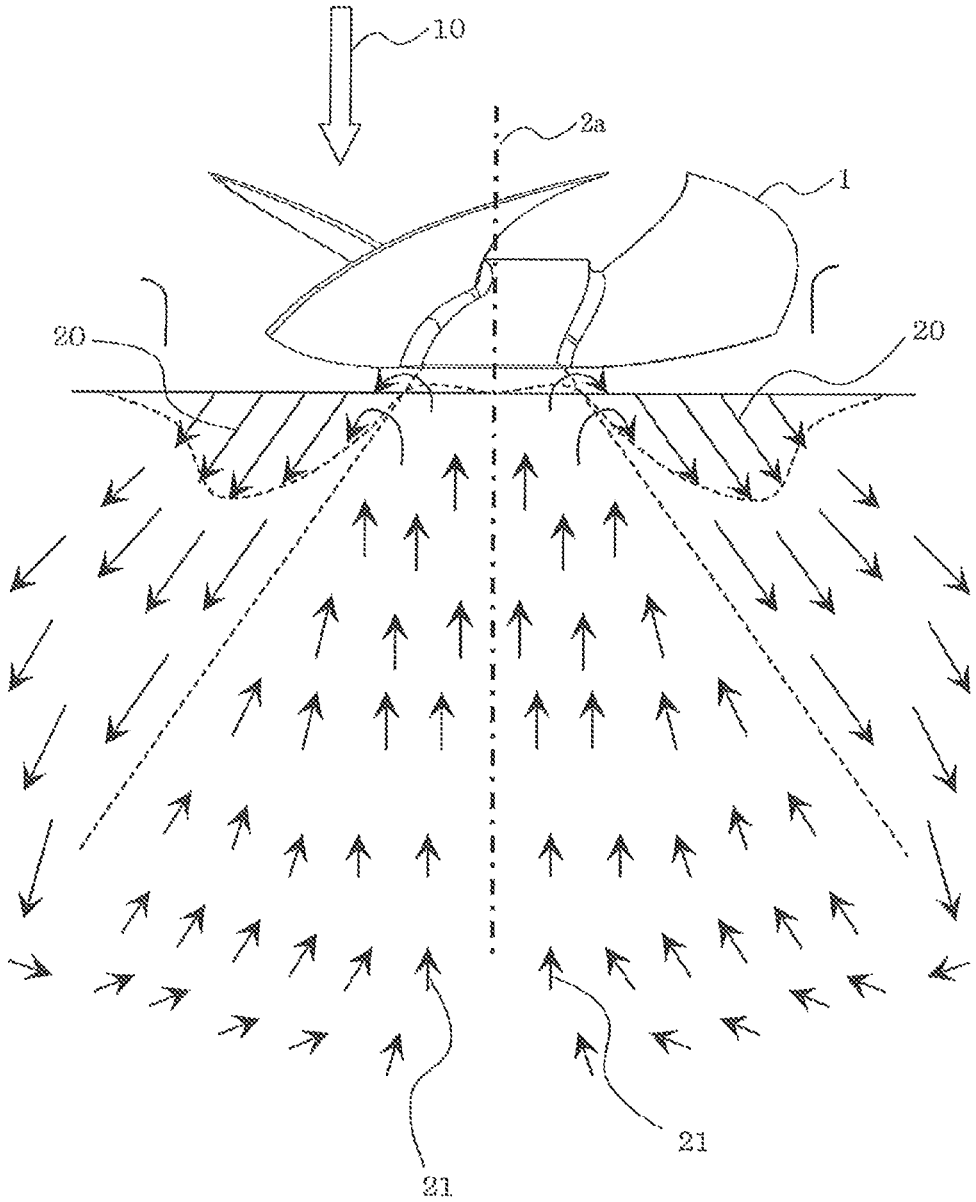
FIG. 26 RELATED ART
FIG. 26 is a wind-direction diagram in the direction of the rotation axis, illustrating the air current formed by the boss-equipped propeller fan in the related art.

FIG. 26 is a wind-direction diagram in the direction of the rotation axis, illustrating the air current formed by the boss-equipped propeller fan in the related art.

Since a strong centrifugal force acts toward the outer periphery of an outflow air current in a propeller fan, an outflow air current 20 has an outflow angle α of a positive value and expands in an inverted V shape, as shown in FIG. 8.

The air-current components of the boss-equipped propeller fan in the related art are as shown in FIGS. 24 and 25. Assuming that an outflow wind velocity is decomposed into rotation system coordinates (r, θ, z), a wind velocity component in the radial direction can be defined as Vr, a wind velocity component in the rotational direction 11 can be defined as Vθ, and a wind velocity component in the direction of the rotation axis 2*a* of the propeller fan can be defined as Vz.

Since the purpose of the propeller fan is to blow air in the direction of the rotation axis 2*a*, only the wind velocity component Vz corresponds to the amount of air to be blown. In other words, since the Vr component expanding in the outer peripheral direction of the rotation and the rotating Vθ component are not involved in the air-blowing process, these components after being blown out are ultimately converted into heat in the air and lose their energy. Thus, relatively increasing the wind velocity component Vz enhances the air-blowing efficiency, thereby contributing to reduced power consumption of the electric motor.

Furthermore, as shown in FIG. 26, it is clear from actual measurement that the air blown out in the direction of the rotation axis 2*a* flows reversely toward the propeller fan around the rotation axis 2*a*.

The flow of the air current when the propeller fan according to Embodiment 1 rotates is as shown in FIG. 8.

The outflow air current 20 conveyed from the pressure surface 1*a* is blown out as wind V including a combination of a velocity component Vr in the radial direction, a velocity component Vθ in the rotational direction 11, and a velocity component Vz in the direction of the rotation axis 2*a* of the propeller fan.

In an area of the rotation axis 2*a* of the propeller fan, a reverse air current 21 occurs relative to the outflow air current 20 and flows reversely toward the center of the propeller fan. The reverse air current 21 becomes a swirling flow due to negative pressure generated as a result of the rotation of the reinforcement ribs 9, and is forcedly suctioned in the direction of the rotation axis 2*a* of the propeller fan. Because each reinforcement rib 9 has a convex shape toward the leading edge 6 of the propeller fan (i.e., turbo blade shape), this suction effect is same as an effect of a suction-side air current exhibited by a turbo fan.

The air forcedly suctioned in the direction of the rotation axis 2*a* of the propeller fan is pressed like an inverted air current 23 toward the outer periphery of the blades 1 by the pressure surfaces of the reinforcement ribs 9 and inflows onto the pressure surfaces 1*a* of the blades 1. Then, a negative pressure region is formed near the rotation axis 2*a* of the propeller fan, thereby exhibiting an effect of intensifying the flow of the reverse air current 21.

Because the heights of the reinforcement ribs 9 are configured such that the downstream ribs 9*b* are higher than the upstream ribs 9*a*, as described above, the air not colliding against the upstream ribs 9*a* collides against the downstream ribs 9*b*, moves toward the outer periphery of the blades 1, becomes the inverted air current 23, and inflows onto the pressure surfaces 1*a*.

Then, the air travels between the blades, merges with an inflow air current 22 normally inflowing to the pressure surfaces 1*a*, and is blown out in the direction of the outflow air current 20.

To clarify the suction effect of the reinforcement ribs 9, a comparison will be made with the air current in the boss-equipped propeller fan in the related art having no suction effect at all.

As shown in FIG. 26, in the case of the boss-equipped propeller fan in the related art, a stagnant flow near the boss circulates by being attracted toward the outflow air current 20. In contrast, as shown in FIG. 8, in the case of the propeller fan according to Embodiment 1, negative pressure is generated near the rotation axis 2*a* due to the reinforcement ribs 9 so that the reverse air current 21 is suctioned. Thus, the outflow air current 20 is convolved in the direction of the rotation axis 2*a* in a manner similar to a tornado, so that the outflow angle α of the outflow air current 20 is reduced. Specifically, an outflow angle α2 of the propeller fan according to Embodiment 1 is smaller than an outflow angle α1 of the boss-equipped propeller fan in the related art.

Since the wind velocity component Vz in the direction of the rotation axis 2*a* is equal to cos α·V, the wind direction of the outflow air current 20 narrows with decreasing outflow angle α, so that the wind velocity component Vz in the direction of the rotation axis 2*a* is increased, whereby the air-blowing efficiency can be enhanced. When the wind velocity component Vz is relatively increased, the rotation speed for causing the propeller fan to generate the same amount of air can be lowered, thereby allowing for reduced power consumption.

<Modification 1>

Figure 9:
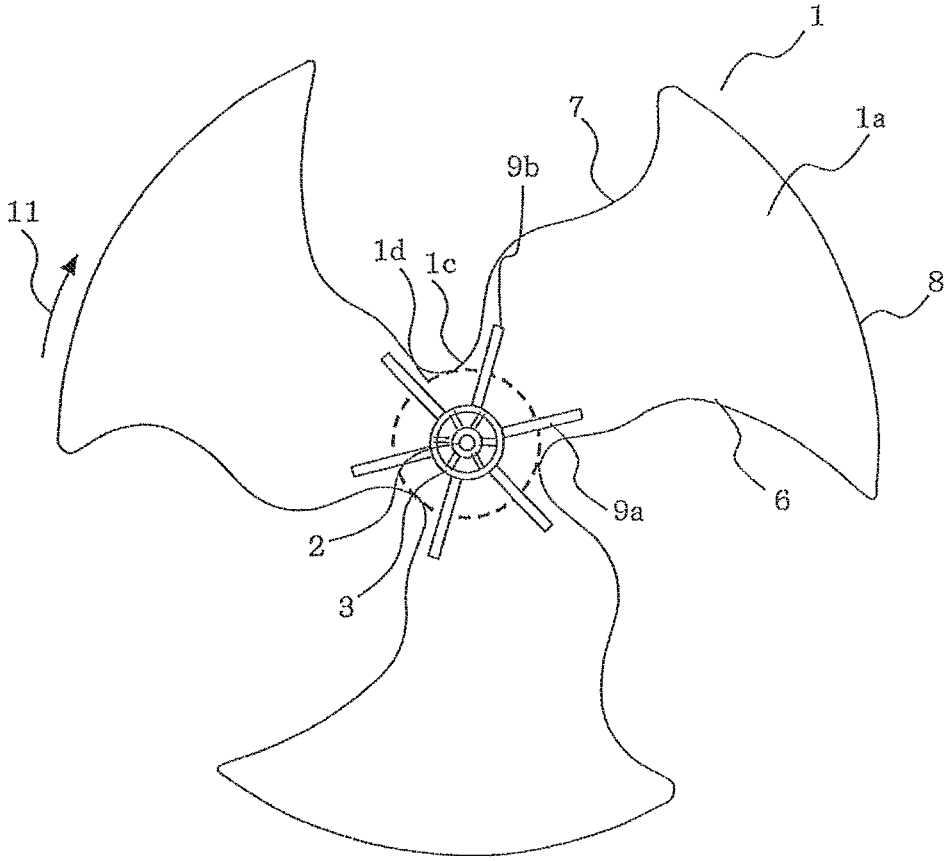
FIG. 9 is a front view of a propeller fan according Modification 1 of Embodiment 1, as viewed from downstream in the fluid flowing direction.

FIG. 9 is a front view of a propeller fan according Modification 1 of Embodiment 1, as viewed from downstream in the fluid flowing direction.

In the description of the propeller fan according to Embodiment 1, each reinforcement rib 9 has a turbo blade shape convex toward the leading edge 6 of the blade 1, when viewed from the front in the direction of the rotation axis 2*a*. Alternatively, as shown in FIG. 9, reinforcement ribs 9 according to Modification 1 have a shape of linear flat plates extending radially from the rotation axis 2*a* of the propeller fan.

Even with such radial flat-plate-shaped reinforcement ribs 9, the air current is forcedly suctioned in the direction of the rotation axis 2*a* of the propeller fan due to negative pressure generated as a result of the rotation of the reinforcement ribs 9, although the negative pressure is slightly weaker than that generated with the turbo blade shape. Thus, the outflow angle α is reduced so that the wind velocity component Vz in the direction of the rotation axis 2*a* is increased, whereby the air-blowing efficiency can be enhanced.

<Advantages>

In the propeller fan according to Embodiment 1 and Modification 1 thereof having the above-described configuration, that is, in a so-called boss-less propeller fan, a plurality of reinforcement ribs 9 extend toward the leading edges 6 and the trailing edges 7 of the blades 1 from the outer peripheral surface of the cylindrical portion 3 having a radius smaller than that of the minimum radius portion 1*d* of the connection portion 1*c*. This is advantageous in that the reverse air current 21 near the rotation axis 2*a* is suctioned by the reinforcement ribs 9. This causes the reverse air current 21 with the increased wind velocity to convolve the outflow air current 20 in the direction of the rotation axis 2*a*, so that the outflow angle α of the outflow air current 20 can be reduced. Thus, the wind velocity component Vz, in the direction of the rotation axis 2*a*, of the outflow air current 20 is relatively increased, whereby the air-blowing efficiency of the fan can be enhanced.

Furthermore, since the blades 1 are smoothly connected by the connection portion 1*c*, stress concentration caused by the centrifugal force acting on the blades 1 is distributed. Moreover, since the reinforcement ribs 9 support the blades 1, strength equivalent to that of a boss-equipped propeller fan is ensured, so that deformation of the blades 1 is suppressed and the air-blowing efficiency can be enhanced. With the blades 1 having increased strength, deterioration in the air-blowing performance caused by deformation of the blades due to the centrifugal force can be suppressed when the propeller fan rotates. Furthermore, the large amount of resin used for a boss is reduced, and the strength equivalent to that of a boss-equipped fan can be ensured with the reinforcement ribs 9 alone, thereby achieving weight reduction (i.e., saving resources).

Furthermore, as shown in FIG. 5, with regard to the shapes of each upstream rib 9*a* and each downstream rib 9*b*, the upper edge 9*ah* of the upstream rib 9*a* is inclined relative to the direction of the central axis of the shaft hole 2, and the upper edge 9*bh* of the downstream rib 9*b* is substantially orthogonal to the direction of the central axis of the shaft hole 2. Therefore, the air current not hitting against the upstream rib 9*a* is pressed against the pressure surface 1*a* of the blade 1 by the downstream rib 9*b*. Thus, the plurality of reinforcement ribs 9 suction the air current six times (i.e., approximately 60° each time) in one cycle (360°) to distribute the air current along the entire perimeter, so that fluctuations in the suctioning negative pressure can be reduced, thereby achieving a stable suction effect with the negative pressure.

Furthermore, as shown in FIG. 6, the cross-sectional radius r1 of the first circular arc 9*c*1 at the leading-edge side of each reinforcement rib 9 is larger than the cross-sectional radius r2 of the second circular arc 9*c*2 at the trailing-edge side. Thus, as compared with the cross-sectional shape with the uniform cross-sectional radius shown in FIG. 7, the fluid flows smoothly along the first circular arc 9*c*1 having the large cross-sectional radius r1, so that a separation vortex of the air current on the second circular arc 9*c*2 at the trailing-edge side is suppressed. Consequently, an energy loss of the fluid is reduced so that the driving force for rotating the propeller fan is reduced, thereby achieving reduced power consumption of the motor.

Furthermore, as shown in FIG. 4 in particular, the connection portion 1*c* is inclined from the leading edge 6 of the neighboring blade 1 toward the trailing edge 7 of the blade 1 in the fluid flowing direction 10. Therefore, the air current inflowing to the pressure surface 1*a* of the connection portion 1*c* is made to smoothly collide against the reinforcement ribs 9, so that the air current can be pressed out toward the outer periphery of the blade 1.

Moreover, the indicator 3*a* indicating the position of the horizontal portion of the D-cut drive shaft is provided between the blades 1 at the outer wall surface of the cylindrical portion 3. Therefore, when fitting the shaft hole 2 of the propeller fan to the drive shaft of the motor, the attaching direction of the propeller fan can be readily identified, thereby shortening the assembly time and improving the working efficiency.

Next, modifications in which the reinforcement ribs 9 of the propeller fan according to Embodiment 1 each have a turbo blade shape will be described.

<Modification 2>

Figure 27:
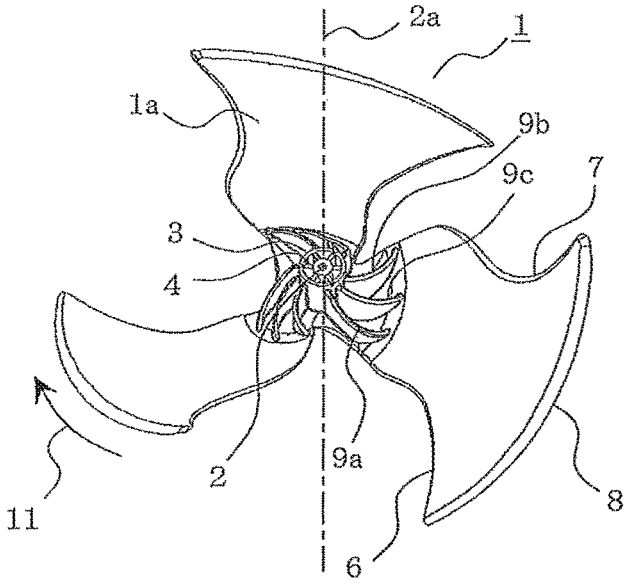
FIG. 27 is a perspective view of a propeller fan according to Modification 2 of Embodiment 1, as viewed from downstream in the fluid flowing direction.

FIG. 27 is a perspective view of a propeller fan according to Modification 2 of Embodiment 1, as viewed from downstream in the fluid flowing direction.

As shown in FIG. 27, reinforcement ribs 9 according to Modification 2 include a third intermediate rib 9*c* disposed between the upstream rib 9*a* and the downstream rib 9*b* according to Embodiment 1 (see FIGS. 2 and 3).

Specifically, each reinforcement rib 9 has a turbo blade shape convex toward the leading edge 6 of the propeller fan, and the upstream rib 9*a*, the intermediate rib 9*c*, and the downstream rib 9*b* are disposed for each blade 1.

Other configurations are the same as those of the propeller fan according to Embodiment 1.

<Advantages>

In Modification 2, three reinforcement ribs 9 are disposed for each blade 1 so that the strength of the blade 1 can be increased, as compared with the propeller fan according to Embodiment 1 in which two reinforcement ribs 9 are disposed for each blade 1. Moreover, since a total number of reinforcement ribs is changed to six to nine, the effect of the reinforcement ribs 9 for suctioning the reverse air current 21 near the rotation axis 2*a* increases. Thus, the wind velocity component Vz, in the direction of the rotation axis 2*a*, of the outflow air current 20 is relatively increased, whereby the air-blowing efficiency of the fan can be enhanced.

<Modification 3>

Figure 28:
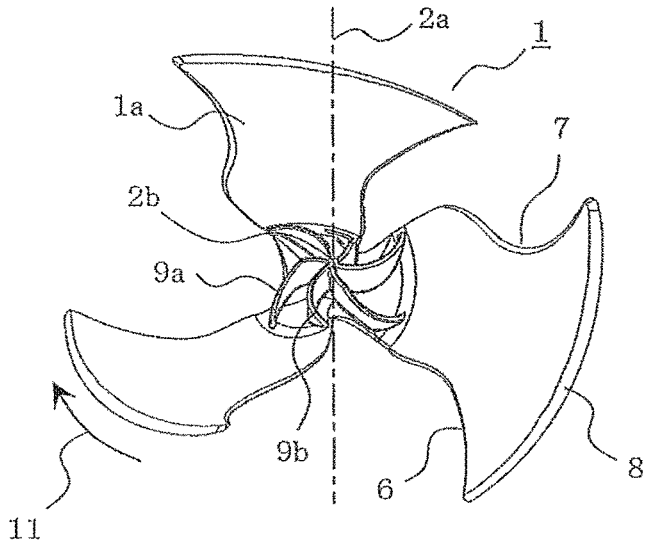
FIG. 28 is a perspective view of a propeller fan according to Modification 3 of Embodiment 1, as viewed from downstream in the fluid flowing direction.

FIG. 28 is a perspective view of a propeller fan according to Modification 3 of Embodiment 1, as viewed from downstream in the fluid flowing direction.

As shown in FIG. 28, reinforcement ribs 9 according to Modification 3 are not provided with the cylindrical portion 3, the shaft hole 2, and the connection ribs 4 according to Embodiment 1, and six turbo-blade-shaped reinforcement ribs 9 (i.e., upstream ribs 9*a* and downstream ribs 9*b*) are joined to one another by extending to and intersecting at the rotation axis 2*a*. Specifically, the six reinforcement ribs 9 intersect one another at the rotation axis 2*a* to form an axial portion 2*b*, and connect the axial portion 2*b* and the plurality of blades 1.

Other configurations are the same as those of the propeller fan according to Embodiment 1.

<Advantages>

Although Modification 3 has a simple configuration in which the cylindrical portion 3, the shaft hole 2, and the connection ribs 4 according to Embodiment 1 are not provided, the reinforcement ribs 9 extend to the rotation axis 2*a* so that the strength of the blades 1 of the propeller fan can be ensured.

<Modification 4>

Figure 29:
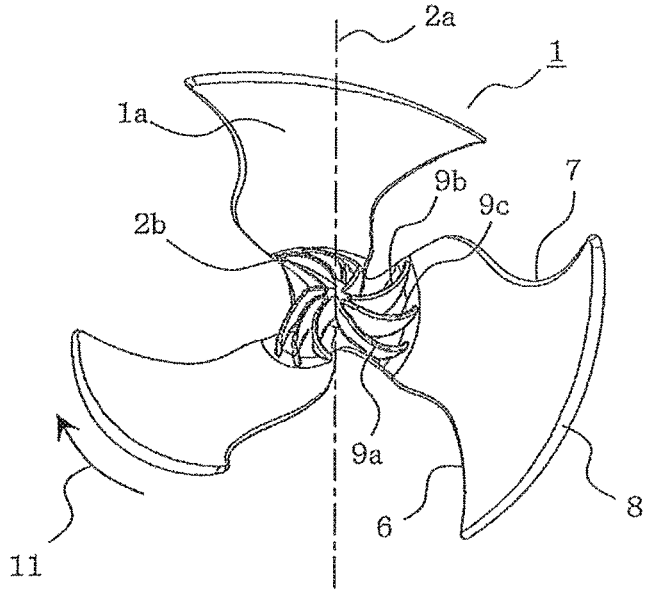
FIG. 29 is a perspective view of a propeller fan according to Modification 4 of Embodiment 1, as viewed from downstream in the fluid flowing direction.

FIG. 29 is a perspective view of a propeller fan according to Modification 4 of Embodiment 1, as viewed from downstream in the fluid flowing direction.

As shown in FIG. 29, reinforcement ribs 9 according to Modification 4 include a third intermediate rib 9*c* disposed between the upstream rib 9*a* and the downstream rib 9*b* according to Modification 3.

Each reinforcement rib 9 has a turbo blade shape convex toward the leading edge 6 of the propeller fan, and the upstream rib 9*a*, the intermediate rib 9*c*, and the downstream rib 9*b* are disposed for each blade 1. The nine reinforcement ribs 9 intersect one another at the rotation axis 2*a* to form an axial portion 2*b*, and connect the axial portion 2*b* and the plurality of blades 1.

Other configurations are the same as those of the propeller fan according to Embodiment 1.

<Advantages>

In Modification 4, three reinforcement ribs 9 are disposed for each blade 1 so that the strength of the blade 1 can be increased, as compared with the propeller fan according to Modification 3 in which two reinforcement ribs 9 are disposed for each blade 1. Moreover, since a total number of reinforcement ribs is changed to six to nine, the effect of the reinforcement ribs 9 for suctioning the reverse air current 21 near the rotation axis 2*a* increases. Thus, the wind velocity component Vz, in the direction of the rotation axis 2*a*, of the outflow air current 20 is relatively increased, whereby the air-blowing efficiency of the fan can be enhanced.

<Modification 5>

Figure 30:
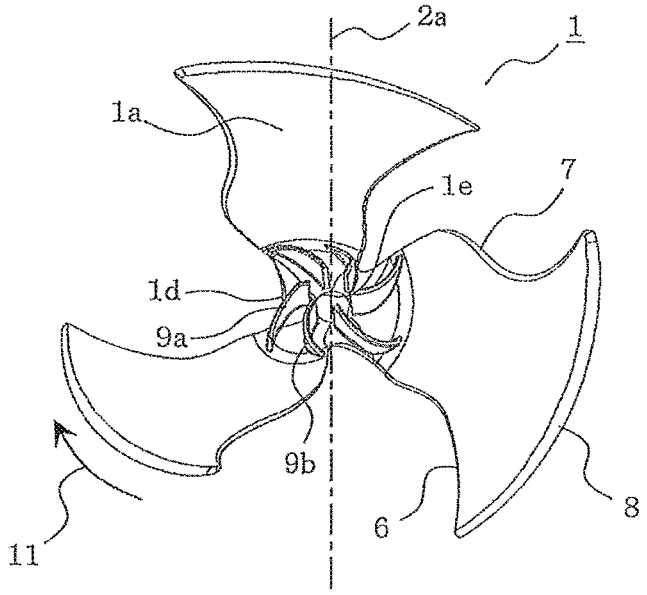
FIG. 30 is a perspective view of a propeller fan according to Modification 5 of Embodiment 1, as viewed from downstream in the fluid flowing direction.

FIG. 30 is a perspective view of a propeller fan according to Modification 5 of Embodiment 1, as viewed from downstream in the fluid flowing direction.

As shown in FIG. 30, reinforcement ribs 9 according to Modification 5 are not provided with the cylindrical portion 3, the shaft hole 2, and the connection ribs 4 according to Embodiment 1, and a circular opening 1*e* for attaching the drive shaft of the motor thereto is provided around the rotation axis 2*a*. Six turbo-blade-shaped reinforcement ribs 9 (i.e., upstream ribs 9*a* and downstream ribs 9*b*) extend to the opening edge of the circular opening 1*e*.

Specifically, a minimum radius portion 1*d* having a radius defined by the shortest distance between the rotation axis 2*a* and the connection portion 1*c* is provided around the rotation axis 2*a*, and the circular opening 1*e* with the rotation axis 2*a* as the central axis and having a radius smaller than the radius of the minimum radius portion 1*d* is provided in the minimum radius portion 1*d*. The reinforcement ribs 9 connect the opening edge of the circular opening 1*e* and the plurality of blades 1.

Other configurations are the same as those of the propeller fan according to Embodiment 1.

<Advantages>

Although Modification 5 has a simple configuration in which the cylindrical portion 3, the shaft hole 2, and the connection ribs 4 according to Embodiment 1 are not provided, the reinforcement ribs 9 extend to the opening edge of the circular opening 1*e* so that the strength of the blades 1 of the propeller fan can be ensured.

<Modification 6>

Figure 31:
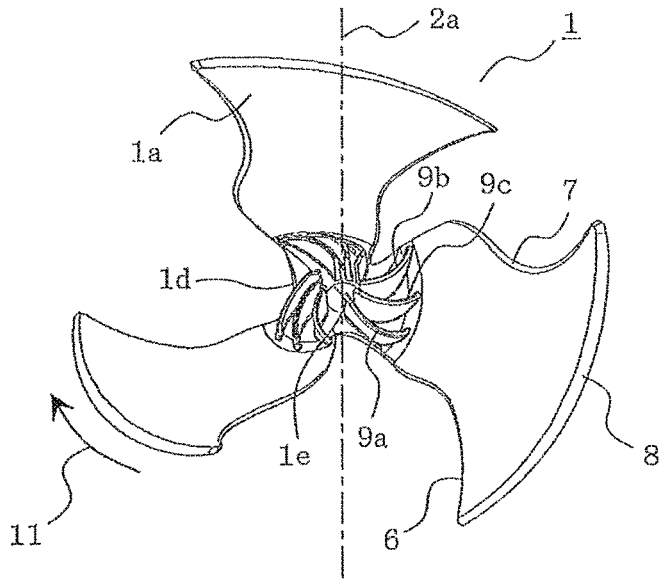
FIG. 31 is a perspective view of a propeller fan according to Modification 6 of Embodiment 1, as viewed from downstream in the fluid flowing direction.

FIG. 31 is a perspective view of a propeller fan according to Modification 6 of Embodiment 1, as viewed from downstream in the fluid flowing direction.

As shown in FIG. 31, reinforcement ribs 9 according to Modification 6 include a third intermediate rib 9*c* disposed between the upstream rib 9*a* and the downstream rib 9*b* according to Modification 5.

Specifically, each reinforcement rib 9 has a turbo blade shape convex toward the leading edge 6 of the propeller fan, and the upstream rib 9*a*, the intermediate rib 9*c*, and the downstream rib 9*b* are disposed for each blade 1.

Other configurations are the same as those of the propeller fan according to Embodiment 1.

<Advantages>

In Modification 6, three reinforcement ribs 9 are disposed for each blade 1 so that the strength of the blade 1 can be increased, as compared with the propeller fan according to Modification 5 in which two reinforcement ribs 9 are disposed for each blade 1. Moreover, since a total number of reinforcement ribs is changed to six to nine, the effect of the reinforcement ribs 9 for suctioning the reverse air current 21 near the rotation axis 2*a* increases. Thus, the wind velocity component Vz, in the direction of the rotation axis 2*a*, of the outflow air current 20 is relatively increased, whereby the air-blowing efficiency of the fan can be enhanced.

Next, modifications in which the reinforcement ribs 9 of the propeller fan have a shape of linear flat plates extending radially from the rotation axis 2*a* will be described.

<Modification 7>

Figure 32:
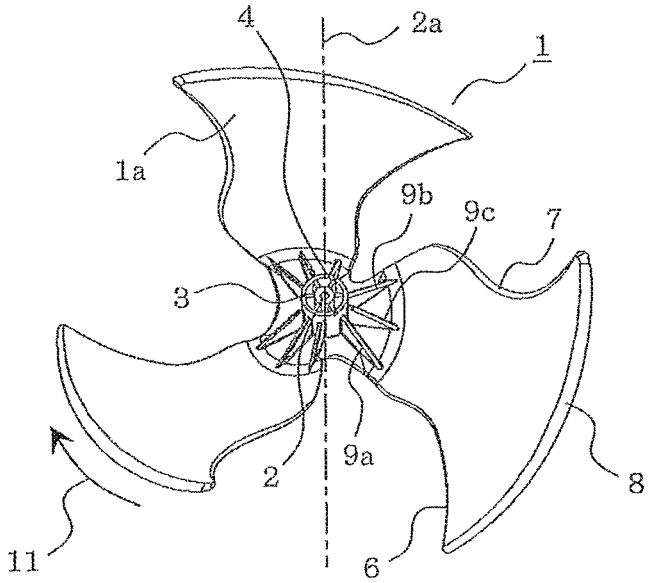
FIG. 32 is a perspective view of a propeller fan according to Modification 7 of Embodiment 1, as viewed from downstream in the fluid flowing direction.

FIG. 32 is a perspective view of a propeller fan according to Modification 7 of Embodiment 1, as viewed from downstream in the fluid flowing direction.

As shown in FIG. 32, reinforcement ribs 9 according to Modification 7 include a third intermediate rib 9*c* disposed between the upstream rib 9*a* and the downstream rib 9*b* according to Modification 1 (see FIG. 9) of Embodiment 1.

Specifically, the reinforcement ribs 9 have the shape of linear flat plates extending radially from the rotation axis 2*a* of the propeller fan, and the upstream rib 9*a*, the intermediate rib 9*c*, and the downstream rib 9*b* are disposed for each blade 1.

Other configurations are the same as those of the propeller fan according to Embodiment 1.

<Advantages>

In Modification 7, three reinforcement ribs 9 are disposed for each blade 1 so that the strength of the blade 1 can be increased, as compared with the propeller fan according to Modification 1 of Embodiment 1 in which two reinforcement ribs 9 are disposed for each blade 1. Moreover, since a total number of reinforcement ribs is changed to six to nine, the effect of the reinforcement ribs 9 for suctioning the reverse air current 21 near the rotation axis 2*a* increases. Thus, the wind velocity component Vz, in the direction of the rotation axis 2*a*, of the outflow air current 20 is relatively increased, whereby the air-blowing efficiency of the fan can be enhanced.

<Modification 8>

Figure 33:
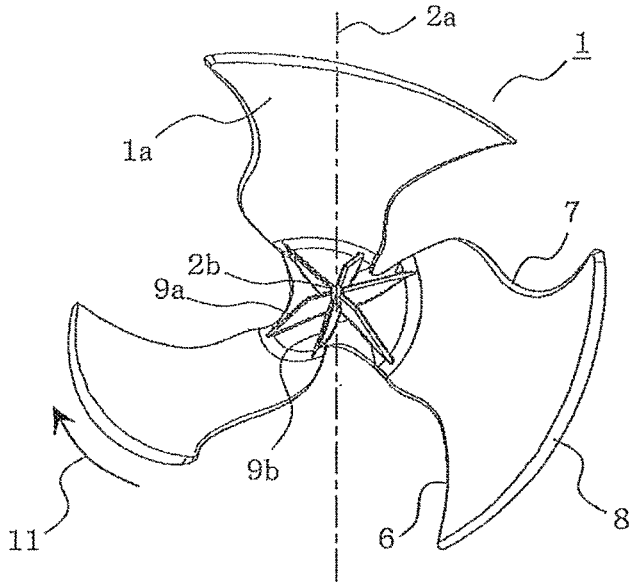
FIG. 33 is a perspective view of a propeller fan according to Modification 8 of Embodiment 1, as viewed from downstream in the fluid flowing direction.

FIG. 33 is a perspective view of a propeller fan according to Modification 8 of Embodiment 1, as viewed from downstream in the fluid flowing direction.

As shown in FIG. 33, reinforcement ribs 9 according to Modification 8 are not provided with the cylindrical portion 3, the shaft hole 2, and the connection ribs 4 according to Embodiment 1, and six linear-flat-plate-shaped reinforcement ribs 9 (i.e., upstream ribs 9*a* and downstream ribs 9*b*) extending radially from the rotation axis 2*a* are joined to one another by extending to and intersecting at the rotation axis 2*a*. Specifically, the six reinforcement ribs 9 intersect one another at the rotation axis 2*a* to form an axial portion 2*b*, and connect the axial portion 2*b* and the plurality of blades 1.

Other configurations are the same as those of the propeller fan according to Embodiment 1.

<Advantages>

Although Modification 8 has a simple configuration in which the cylindrical portion 3, the shaft hole 2, and the connection ribs 4 according to Embodiment 1 are not provided, the reinforcement ribs 9 extend to the rotation axis 2*a* so that the strength of the blades 1 of the propeller fan can be ensured.

<Modification 9>

Figure 34:
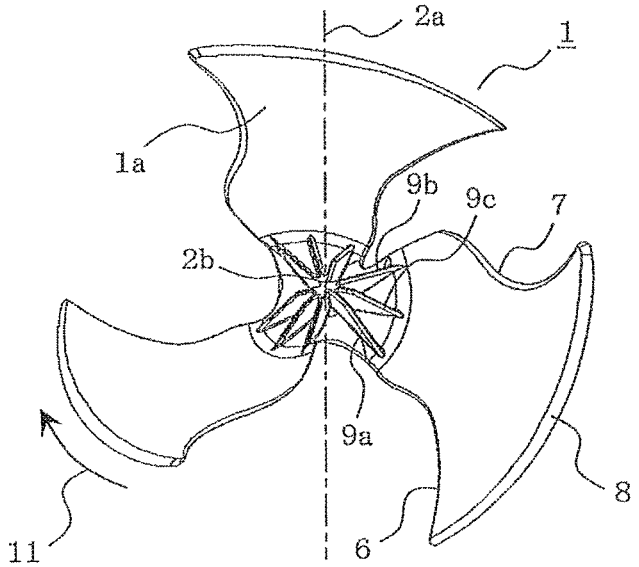
FIG. 34 is a perspective view of a propeller fan according to Modification 9 of Embodiment 1, as viewed from downstream in the fluid flowing direction.

FIG. 34 is a perspective view of a propeller fan according to Modification 9 of Embodiment 1, as viewed from downstream in the fluid flowing direction.

As shown in FIG. 34, reinforcement ribs 9 according to Modification 9 include a third intermediate rib 9*c* disposed between the upstream rib 9*a* and the downstream rib 9*b* according to Modification 8.

Specifically, the reinforcement ribs 9 have a shape of linear flat plates extending radially from the rotation axis 2*a* of the propeller fan, and the upstream rib 9*a*, the intermediate rib 9*c*, and the downstream rib 9*b* are disposed for each blade 1. The nine reinforcement ribs 9 intersect one another at the rotation axis 2*a* to form an axial portion 2*b*, and connect the axial portion 2*b* and the plurality of blades 1.

Other configurations are the same as those of the propeller fan according to Embodiment 1.

<Advantages>

In Modification 9, three reinforcement ribs 9 are disposed for each blade 1 so that the strength of the blade 1 can be increased, as compared with the propeller fan according to Modification 8 in which two reinforcement ribs 9 are disposed for each blade 1. Moreover, since a total number of reinforcement ribs is changed to six to nine, the effect of the reinforcement ribs 9 for suctioning the reverse air current 21 near the rotation axis 2*a* increases. Thus, the wind velocity component Vz, in the direction of the rotation axis 2*a*, of the outflow air current 20 is relatively increased, whereby the air-blowing efficiency of the fan can be enhanced.

<Modification 10>

Figure 35:
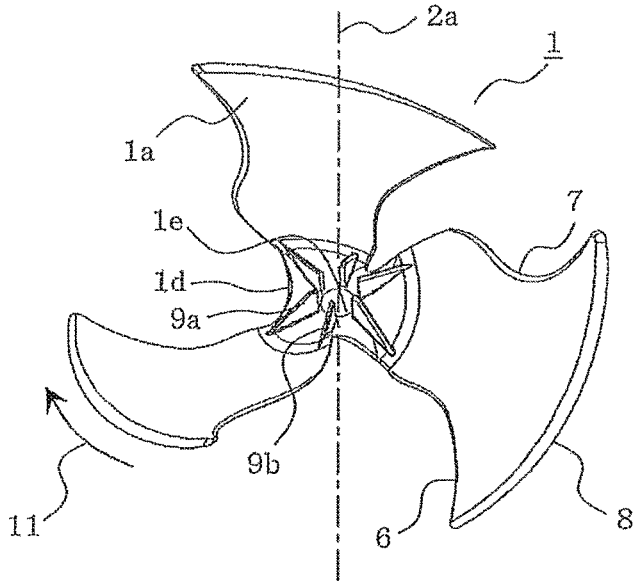
FIG. 35 is a perspective view of a propeller fan according to Modification 10 of Embodiment 1, as viewed from downstream in the fluid flowing direction.

FIG. 35 is a perspective view of a propeller fan according to Modification 10 of Embodiment 1, as viewed from downstream in the fluid flowing direction.

As shown in FIG. 35, reinforcement ribs 9 according to Modification 10 are not provided with the cylindrical portion 3, the shaft hole 2, and the connection ribs 4 according to Embodiment 1, and a circular opening 1*e* for attaching the drive shaft of the motor thereto is provided around the rotation axis 2*a*. Six linear-flat-plate-shaped reinforcement ribs 9 (i.e., upstream ribs 9*a* and downstream ribs 9*b*) extending radially from the rotation axis 2*a* extend to the opening edge of the circular opening 1*e*.

Specifically, a minimum radius portion 1*d* having a radius defined by the shortest distance between the rotation axis 2*a* and the connection portion 1*c* is provided around the rotation axis 2*a*, and the circular opening 1*e* with the rotation axis 2*a* as the central axis and having a radius smaller than the radius of the minimum radius portion 1*d* is provided in the minimum radius portion 1*d*. The reinforcement ribs 9 connect the opening edge of the circular opening 1*e* and the plurality of blades 1.

Other configurations are the same as those of the propeller fan according to Embodiment 1.

<Advantages>

Although Modification 10 has a simple configuration in which the cylindrical portion 3, the shaft hole 2, and the connection ribs 4 according to Embodiment 1 are not provided, the reinforcement ribs 9 extend to the opening edge of the circular opening 1*e* so that the strength of the blades 1 of the propeller fan can be ensured.

<Modification 11>

Figure 36:
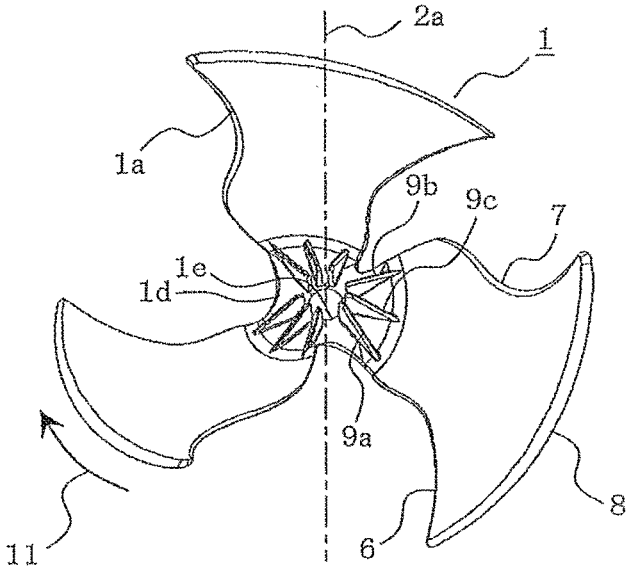
FIG. 36 is a perspective view of a propeller fan according to Modification 11 of Embodiment 1, as viewed from downstream in the fluid flowing direction.

FIG. 36 is a perspective view of a propeller fan according to Modification 11 of Embodiment 1, as viewed from downstream in the fluid flowing direction.

As shown in FIG. 36, reinforcement ribs 9 according to Modification 11 include a third intermediate rib 9*c* disposed between the upstream rib 9*a* and the downstream rib 9*b* according to Modification 10.

Specifically, the reinforcement ribs 9 have a shape of linear flat plates extending radially from the rotation axis 2*a* of the propeller fan, and the upstream rib 9*a*, the intermediate rib 9*c*, and the downstream rib 9*b* are disposed for each blade 1.

Other configurations are the same as those of the propeller fan according to Embodiment 1.

<Advantages>

In Modification 11, three reinforcement ribs 9 are disposed for each blade 1 so that the strength of the blade 1 can be increased, as compared with the propeller fan according to Modification 10 in which two reinforcement ribs 9 are disposed for each blade 1. Moreover, since a total number of reinforcement ribs is changed to six to nine, the effect of the reinforcement ribs 9 for suctioning the reverse air current 21 near the rotation axis 2*a* increases. Thus, the wind velocity component Vz, in the direction of the rotation axis 2*a*, of the outflow air current 20 is relatively increased, whereby the air-blowing efficiency of the fan can be enhanced.

Although the above-described examples relate to cases where two or three reinforcement ribs 9 are disposed for each blade 1, four or more reinforcement ribs 9 may be provided.

Moreover, the number of blades 1 is not particularly limited so long as there are two or more blades.

Embodiment 2

A propeller fan according to Embodiment 2 is only different from the propeller fan according to Embodiment 1 in terms of the shape of the reinforcement ribs 9. Therefore, the configuration of the reinforcement ribs 9 will be described.

Figure 10:
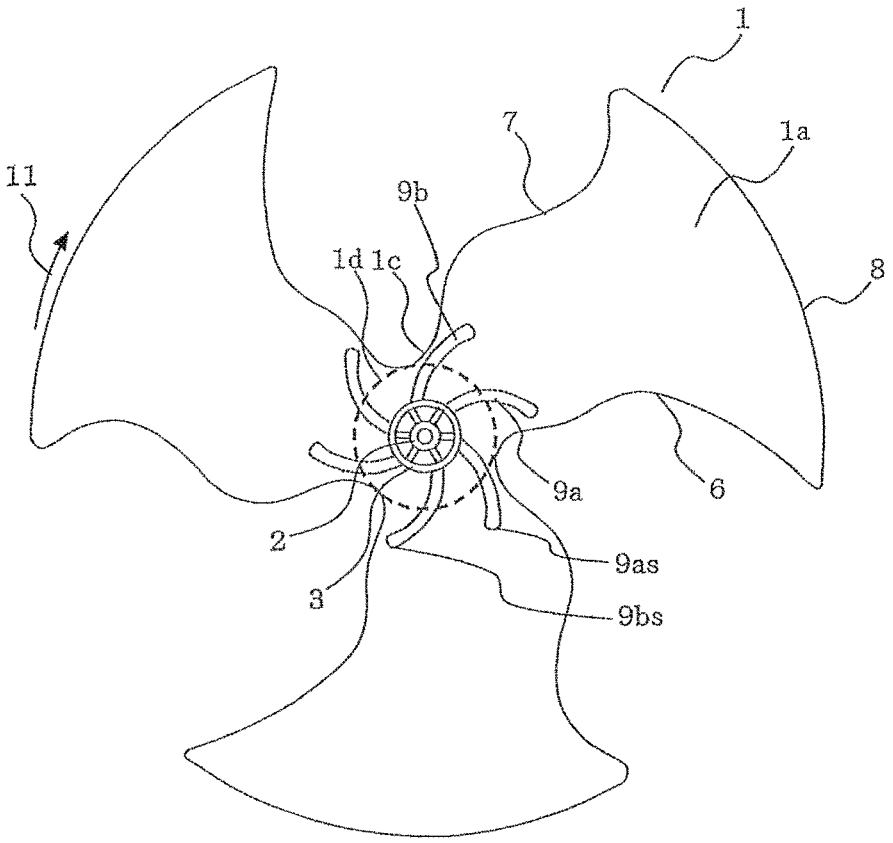
FIG. 10 is a front view of a propeller fan according to Embodiment 2, as viewed from downstream in the fluid flowing direction.

FIG. 10 is a front view of the propeller fan according to Embodiment 2, as viewed from downstream in the fluid flowing direction.

As shown in FIG. 10, when viewed from the front in the direction of the rotation axis 2*a*, each reinforcement rib 9 according to Embodiment 2 has a sirocco blade shape curved and convex toward the trailing edge 7 of the corresponding blade 1.

<Advantages>

With the reinforcement ribs 9 having such a sirocco blade shape, the air pressed as a result of the rotation of the reinforcement ribs 9 is collected toward the rotation axis 2*a*, so that the air is sent in the axial direction. In other words, an effect similar to a case where a mini propeller fan is provided at the center of each blade 1 is exhibited. Thus, the wind velocity component Vz in the direction of the rotation axis 2*a* is increased, whereby the air-blowing efficiency can be enhanced at a low-pressure-loss operating point to be described later.

The following description relates to a difference in effects between the case where the reinforcement ribs 9 have the turbo blade shape convex toward the leading edge 6 or have the shape of radially-extending linear flat plates in accordance with Embodiment 1 and the case where the reinforcement ribs 9 have the sirocco blade shape curved and convex toward the trailing edge 7 in accordance with Embodiment 2.

Figure 11:
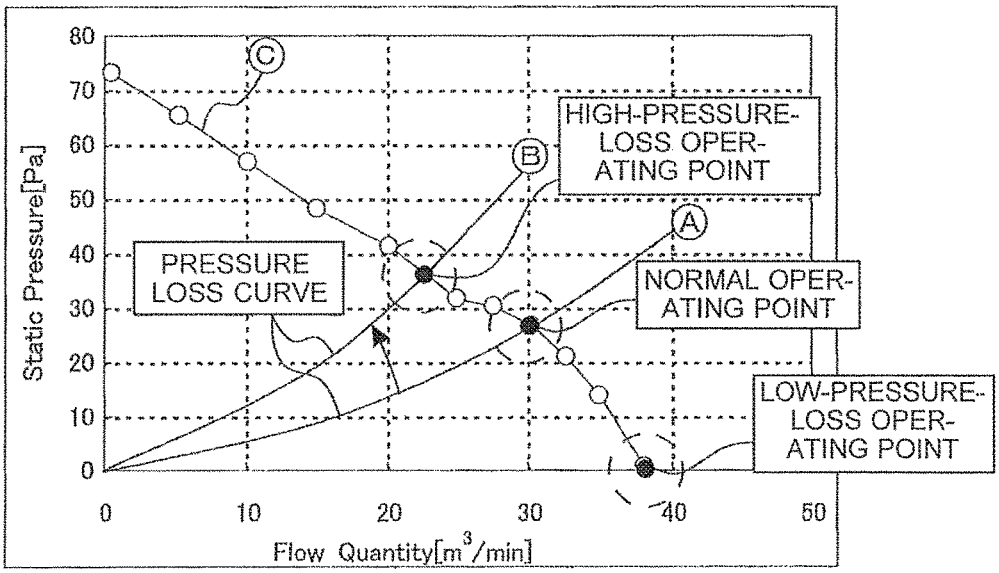
FIG. 11 is a P-Q diagram illustrating air-blowing performance of a propeller fan.

FIG. 11 is a P-Q diagram illustrating the air-blowing performance of a propeller fan.

Generally, the air-blowing performance of a propeller fan is expressed with the relationship (i.e., P-Q diagram) between the pressure (i.e., static pressure) of the fluid and the amount of air per unit time, as shown in FIG. 11. When there is large resistance in the air path of the propeller fan, it is known that a pressure loss curve rises from a normal pressure loss curve A to a high pressure loss curve B, causing an operating point serving as an intersection point between the pressure loss curve and a performance characteristic curve C of the propeller fan to move. The high pressure loss curve B is set such that the pressure loss in the flow path is doubled relative that in the normal pressure loss curve A.

An intersection point between the normal pressure loss curve A and the performance characteristic curve C serves as a normal operating point, an intersection point between the high pressure loss curve B and the performance characteristic curve C serves as a high-pressure-loss operating point, and an intersection point between a zero static pressure point and the performance characteristic curve C serves as a low-pressure-loss operating point.

In the case where the reinforcement ribs 9 in Embodiment 1 each have the turbo blade shape convex toward the leading edge 6 or have the shape of radially-extending linear flat plates, negative pressure generated as a result of the rotation of the reinforcement ribs 9 causes the turbo blades to forcedly suction the air current in the direction of the rotation axis 2*a* of the propeller fan. Due to this turbo blade effect, the above-described cases are suitable for use in a condition in which there is flow-path resistance at the normal operating point or high-pressure-loss operating point requiring static pressure.

In the case where the reinforcement ribs 9 in Embodiment 2 have the sirocco blade shape curved and convex toward the trailing edge 7, the air pressed as a result of the rotation of the reinforcement ribs 9 is collected toward the rotation axis 2*a*, so that the reinforcement ribs 9 send air in the direction of the rotation axis 2*a* to function similarly to mini propeller fans. Thus, the above-described case is suitable for use at the low-pressure-loss operating point where there is low flow-path resistance not requiring static pressure but requiring a certain amount of air.

Next, modifications in which the reinforcement ribs 9 of the propeller fan according to Embodiment 2 each have a sirocco blade shape will be described.

<Modification 1>

Figure 37:
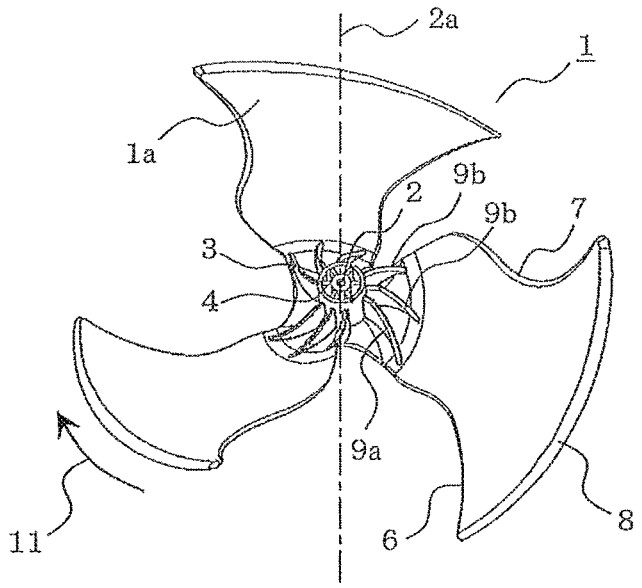
FIG. 37 is a perspective view of a propeller fan according to Modification 1 of Embodiment 2, as viewed from downstream in the fluid flowing direction.

FIG. 37 is a perspective view of a propeller fan according to Modification 1 of Embodiment 2, as viewed from downstream in the fluid flowing direction.

As shown in FIG. 37, reinforcement ribs 9 according to Modification 1 include a third intermediate rib 9*c* disposed between the upstream rib 9*a* and the downstream rib 9*b* according to Embodiment 2 (see FIG. 10).

Specifically, each reinforcement rib 9 has a sirocco blade shape convex toward the trailing edge 7 of the propeller fan, and the upstream rib 9*a*, the intermediate rib 9*c*, and the downstream rib 9*b* are disposed for each blade 1.

Other configurations are the same as those of the propeller fan according to Embodiment 2.

<Advantages>

In Modification 1, three reinforcement ribs 9 are disposed for each blade 1 so that the strength of the blade 1 can be increased, as compared with the propeller fan according to Embodiment 2 in which two reinforcement ribs 9 are disposed for each blade 1. Moreover, since a total number of reinforcement ribs is changed to six to nine, the air pressed as a result of the rotation of the reinforcement ribs 9 is collected toward the rotation axis 2*a*, so that the effect of sending the air in the direction of the rotation axis 2*a* is improved. In other words, an effect similar to a case where a mini propeller fan is provided at the center of each blade 1 is exhibited. Thus, the wind velocity component Vz in the direction of the rotation axis 2*a* is increased, whereby the air-blowing efficiency can be enhanced at the low-pressure-loss operating point.

<Modification 2>

Figure 38:
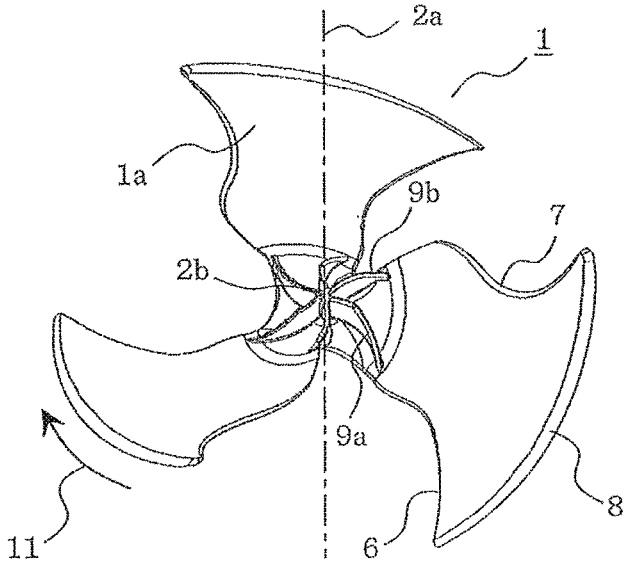
FIG. 38 is a perspective view of a propeller fan according to Modification 2 of Embodiment 2, as viewed from downstream in the fluid flowing direction.

FIG. 38 is a perspective view of a propeller fan according to Modification 2 of Embodiment 2, as viewed from downstream in the fluid flowing direction.

As shown in FIG. 38, reinforcement ribs 9 according to Modification 2 are not provided with the cylindrical portion 3, the shaft hole 2, and the connection ribs 4 according to Embodiment 2 (see FIG. 10), and six sirocco-blade-shaped reinforcement ribs 9 (i.e., upstream ribs 9*a* and downstream ribs 9*b*) are joined to one another by extending to and intersecting at the rotation axis 2*a*. Specifically, the six reinforcement ribs 9 intersect one another at the rotation axis 2*a* to form an axial portion 2*b*, and connect the axial portion 2*b* and the plurality of blades 1.

Other configurations are the same as those of the propeller fan according to Embodiment 2.

<Advantages>

Although Modification 2 has a simple configuration in which the cylindrical portion 3, the shaft hole 2, and the connection ribs 4 according to Embodiment 2 are not provided, the reinforcement ribs 9 extend to the rotation axis 2*a* so that the strength of the blades 1 of the propeller fan can be ensured.

<Modification 3>

Figure 39:
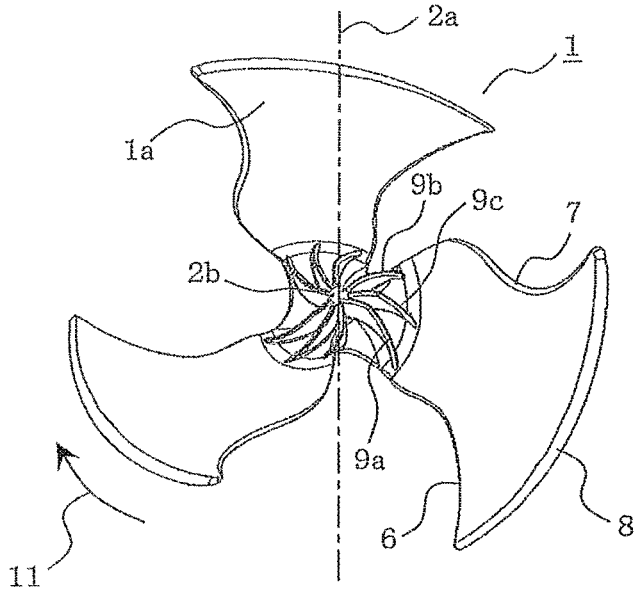
FIG. 39 is a perspective view of a propeller fan according to Modification 3 of Embodiment 2, as viewed from downstream in the fluid flowing direction.

FIG. 39 is a perspective view of a propeller fan according to Modification 3 of Embodiment 2, as viewed from downstream in the fluid flowing direction.

As shown in FIG. 39, reinforcement ribs 9 according to Modification 3 include a third intermediate rib 9*c* disposed between the upstream rib 9*a* and the downstream rib 9*b* according to Modification 2.

Specifically, each reinforcement rib 9 has a sirocco blade shape convex toward the trailing edge 7 of the propeller fan, and the upstream rib 9*a*, the intermediate rib 9*c*, and the downstream rib 9*b* are disposed for each blade 1. The nine reinforcement ribs 9 intersect one another at the rotation axis 2*a* to form an axial portion 2*b*, and connect the axial portion 2*b* and the plurality of blades 1.

Other configurations are the same as those of the propeller fan according to Embodiment 2.

<Advantages>

In Modification 3, three reinforcement ribs 9 are disposed for each blade 1 so that the strength of the blade 1 can be increased, as compared with the propeller fan according to Modification 2 in which two reinforcement ribs 9 are disposed for each blade 1. Moreover, since a total number of reinforcement ribs is changed to six to nine, the air pressed as a result of the rotation of the reinforcement ribs 9 is collected toward the rotation axis 2*a*, so that the effect of sending the air in the direction of the rotation axis 2*a* is improved. In other words, an effect similar to a case where a mini propeller fan is provided at the center of each blade 1 is exhibited. Thus, the wind velocity component Vz in the direction of the rotation axis 2*a* is increased, whereby the air-blowing efficiency can be enhanced at the low-pressure-loss operating point.

<Modification 4>

Figure 40:
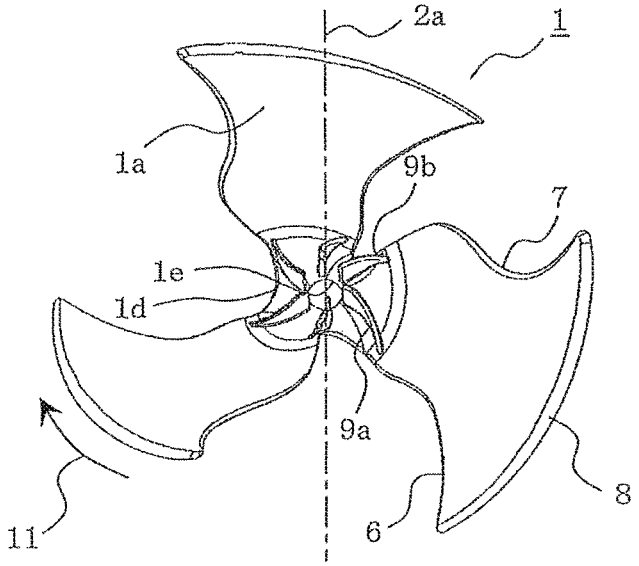
FIG. 40 is a perspective view of a propeller fan according to Modification 4 of Embodiment 2, as viewed from downstream in the fluid flowing direction.

FIG. 40 is a perspective view of a propeller fan according to Modification 4 of Embodiment 2, as viewed from downstream in the fluid flowing direction.

As shown in FIG. 40, reinforcement ribs 9 according to Modification 4 are not provided with the cylindrical portion 3, the shaft hole 2, and the connection ribs 4 according to Embodiment 2, and a circular opening 1*e* for attaching the drive shaft of the motor thereto is provided around the rotation axis 2*a*. Six sirocco-blade-shaped reinforcement ribs 9 (i.e., upstream ribs 9*a* and downstream ribs 9*b*) extend to the opening edge of the circular opening 1*e*.

Specifically, a minimum radius portion 1*d* having a radius defined by the shortest distance between the rotation axis 2*a* and the connection portion 1*c* is provided around the rotation axis 2*a*, and the circular opening 1*e* with the rotation axis 2*a* as the central axis and having a radius smaller than the radius of the minimum radius portion 1*d* is provided in the minimum radius portion 1*d*. The reinforcement ribs 9 connect the opening edge of the circular opening 1*e* and the plurality of blades 1.

Other configurations are the same as those of the propeller fan according to Embodiment 2.

<Advantages>

Although Modification 4 has a simple configuration in which the cylindrical portion 3, the shaft hole 2, and the connection ribs 4 according to Embodiment 1 are not provided, the reinforcement ribs 9 extend to the opening edge of the circular opening 1*e* so that the strength of the blades 1 of the propeller fan can be ensured.

<Modification 5>

Figure 41:
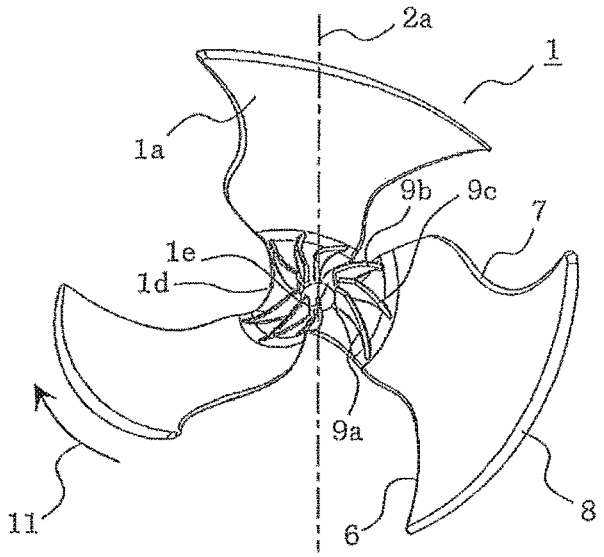
FIG. 41 is a perspective view of a propeller fan according to Modification 5 of Embodiment 2, as viewed from downstream in the fluid flowing direction.

FIG. 41 is a perspective view of a propeller fan according to Modification 5 of Embodiment 2, as viewed from downstream in the fluid flowing direction.

As shown in FIG. 41, reinforcement ribs 9 according to Modification 5 include a third intermediate rib 9*c* disposed between the upstream rib 9*a* and the downstream rib 9*b* according to Modification 4.

Specifically, each reinforcement rib 9 has a sirocco blade shape convex toward the trailing edge 7 of the propeller fan, and the upstream rib 9*a*, the intermediate rib 9*c*, and the downstream rib 9*b* are disposed for each blade 1.

Other configurations are the same as those of the propeller fan according to Embodiment 2.

<Advantages>

In Modification 5, three reinforcement ribs 9 are disposed for each blade 1 so that the strength of the blade 1 can be increased, as compared with the propeller fan according to Modification 5 in which two reinforcement ribs 9 are disposed for each blade 1. Moreover, since a total number of reinforcement ribs is changed to six to nine, the air pressed as a result of the rotation of the reinforcement ribs 9 is collected toward the rotation axis 2*a*, so that the effect of sending the air in the direction of the rotation axis 2*a* is improved. In other words, an effect similar to a case where a mini propeller fan is provided at the center of each blade 1 is exhibited. Thus, the wind velocity component Vz in the direction of the rotation axis 2*a* is increased, whereby the air-blowing efficiency can be enhanced at the low-pressure-loss operating point.

Embodiment 3

Embodiment 3 corresponds to a case where the blades 1 of the propeller fan according to Embodiment 1 or 2 are inclined in the fluid flowing direction 10 (i.e., a rearward-inclined type to be described below).

Figure 12:
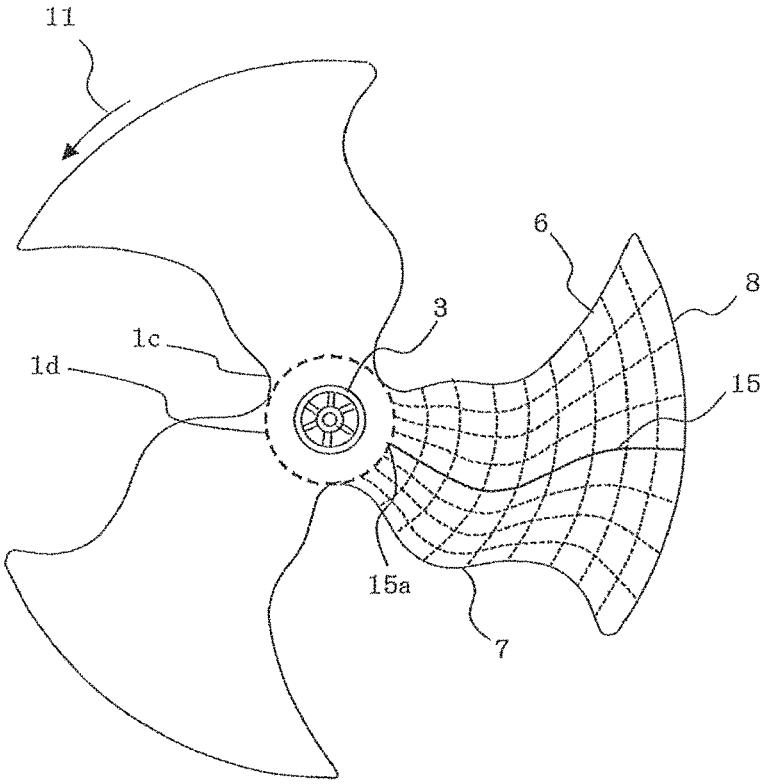
FIG. 12 illustrates the position of a blade chord center line in a front view of a propeller fan according to Embodiment 3.

FIG. 12 illustrates the position of a blade chord center line 15 in a front view of a propeller fan according to Embodiment 3.

Figure 13:
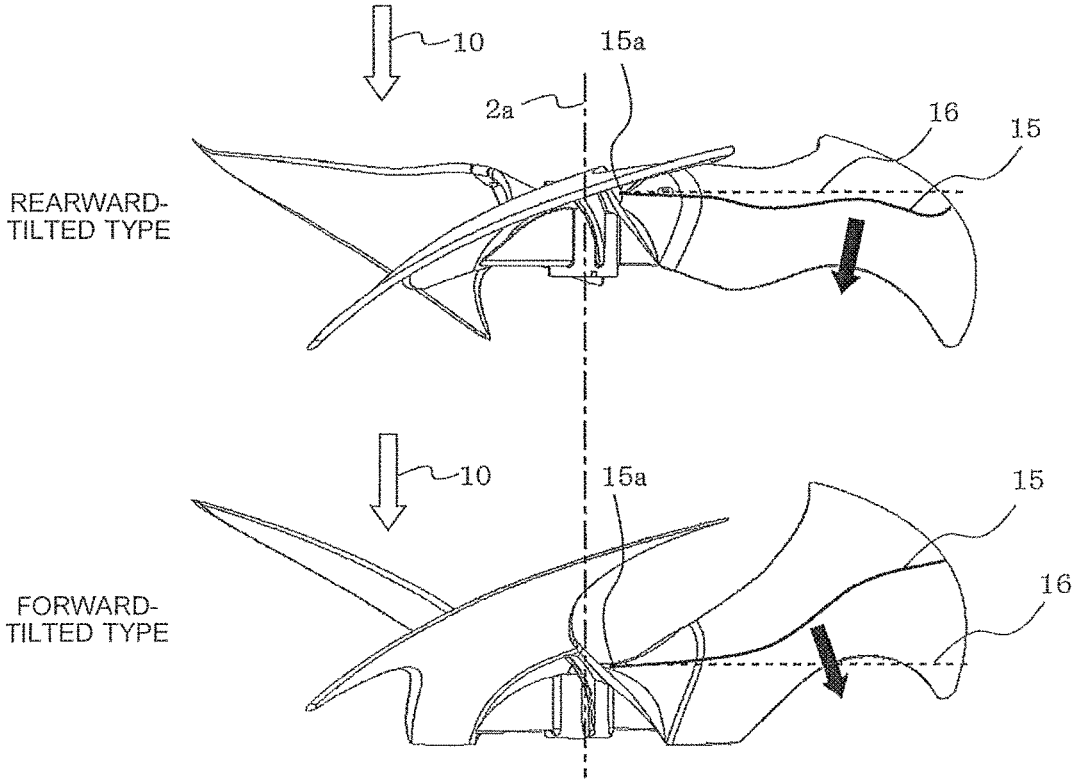
FIG. 13 illustrates the position of the blade chord center line in a side view comparing the rearward-inclined-type propeller fan according to Embodiment 3 with a forward-inclined-type propeller fan.

FIG. 13 illustrates the position of the blade chord center line 15 in a side view comparing the rearward-inclined-type propeller fan according to Embodiment 3 with a forward-inclined-type propeller fan.

The blade chord center line 15 is a group of center points on specific circumferences of each blade 1.

In FIG. 13, with regard to the blade chord center line 15 of each rearward-inclined blade 1, when an orthogonal plane 16 extending in a direction orthogonal to the rotation axis 2*a* is drawn from a contact point 15*a* at the outer wall surface of the cylindrical portion 3, the blade chord center line 15 is located downstream of the orthogonal plane 16 in the fluid flowing direction 10. In contrast, the blade chord center line 15 of each forward-inclined blade 1 is located upstream of the orthogonal plane 16 in the fluid flowing direction 10.

Thus, in the rearward-inclined-type propeller fan according to Embodiment 3, each blade 1 has a shape in which the blade chord center line 15 is disposed downstream of the orthogonal plane 16 in the fluid flowing direction (referred to as a rearward-inclined type hereinafter).

An arrow on the blade 1 shown in FIG. 13 indicates a direction in which the air is pressed when the blade 1 rotates, and is inclined toward the inner periphery of the blade 1 in the rearward-inclined-type propeller fan (=closed flow).

In contrast to the rearward-inclined type, the forward-inclined-type propeller fan in FIG. 13 for a comparison is configured such that the direction in which the air is pressed is inclined toward the outer periphery of the blade 1 (=open flow).

Next, the difference in wind velocity component Vz in the direction parallel to the rotation axis 2*a* between the forward-inclined-type propeller fan and the rearward-inclined-type propeller fan will be described with reference to FIG. 14.

Figure 14:
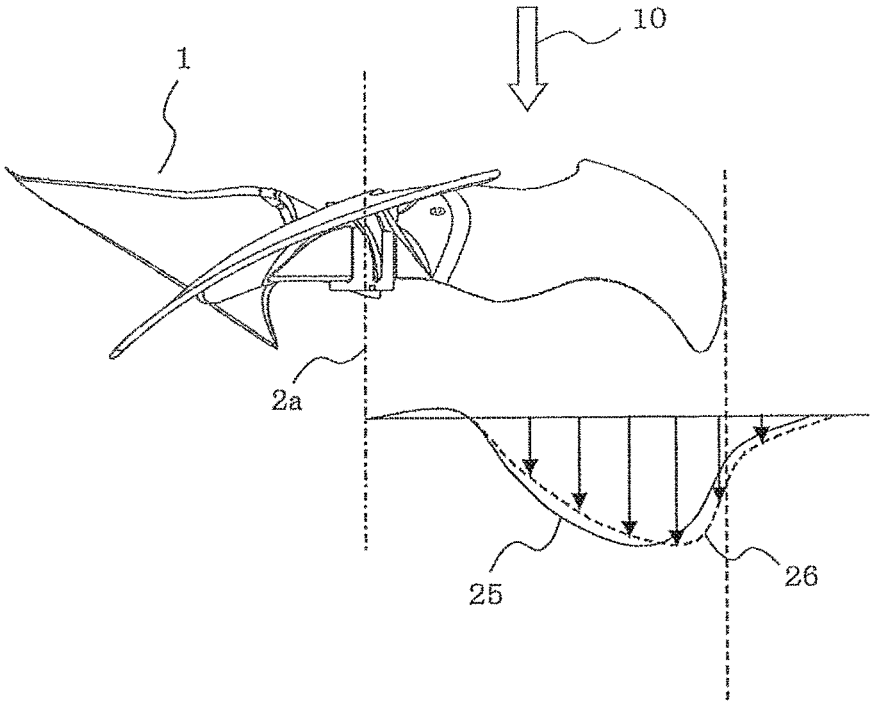
FIG. 14 is a diagram comparing velocity distribution (rearward-inclined type) of the rearward-inclined-type propeller fan according to Embodiment 3 with velocity distribution (forward-inclined type) of the forward-inclined-type propeller fan.

FIG. 14 is a diagram comparing a velocity component 25 of the rearward-inclined-type propeller fan according to Embodiment 3 with a velocity component 26 of the forward-inclined type propeller fan.

Since the direction in which the air is pressed against each blade 1 varies in an area with the maximum wind velocity component Vz (i.e., an area with a large amount of air), the peak position of the velocity component 25 corresponding to the rearward-inclined type tends to be located toward the inner periphery of the blade 1 than that of the velocity component 26 corresponding to the forward-inclined type.

As shown in the drawing, the rearward-inclined-type propeller fan according to Embodiment 3 suppresses expansion of the velocity distribution of the air current toward the outer periphery of the blade 1, so that the outflow angle $\alpha$ ($\alpha$ being a positive value as explained with reference to FIG. 8) of the outflow air current 20 can be reduced.

Although an example of a blade shape in which the blade chord center line 15 in the rearward-inclined type is entirely disposed downstream of the orthogonal plane 16 in the fluid flowing direction, a function and an effect similar to the above are exhibited so long as the blade 1 has a shape in which 70% or more of the length of the blade chord center line 15 is disposed downstream of the orthogonal plane 16 in the fluid flowing direction.

<Advantages>

The propeller fan according to Embodiment 3 employs the rearward-inclined blades 1 so that the outflow angle $\alpha$ of the outflow air current 20 can be reduced, in addition to the effects according to Embodiment 1. Thus, the wind velocity component Vz, in the direction of the rotation axis 2*a*, of the outflow air current 20 is relatively increased, whereby the air-blowing efficiency of the fan can be enhanced.

Embodiment 4

A propeller fan according to Embodiment 4 is an example in which the propeller fan according to any one of Embodiment 1 to Embodiment 3 is applied to an outdoor unit 30 of an air-conditioning apparatus. This propeller fan has a function of sending outdoor air for heat exchange to an outdoor heat exchanger 31.

Figure 15:
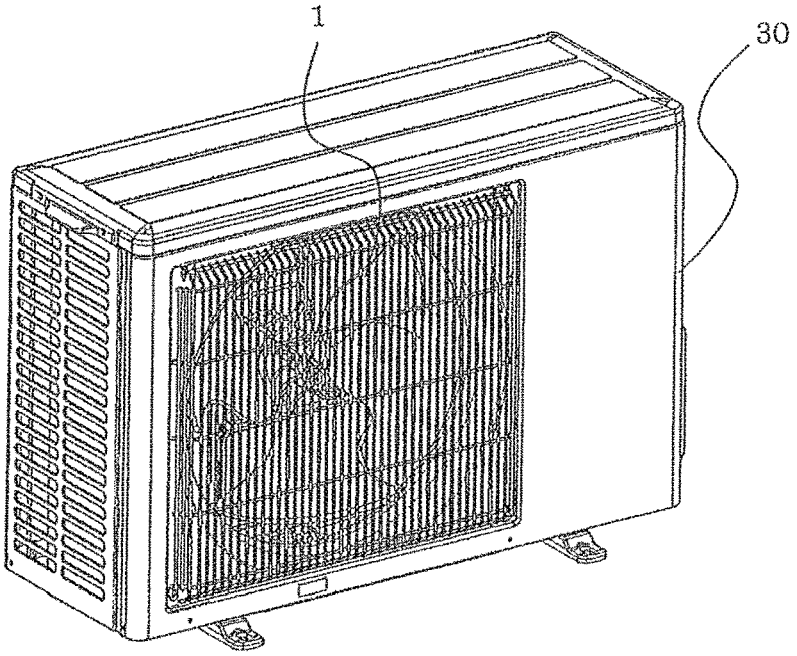
FIG. 15 is an external perspective view in a case where the propeller fan according to any one of Embodiment 1 to Embodiment 3 is attached to an outdoor unit according to Embodiment 4.

FIG. 15 is an external perspective view in a case where the propeller fan according to any one of Embodiment 1 to Embodiment 3 is attached to the outdoor unit according to Embodiment 4.

Figure 16:
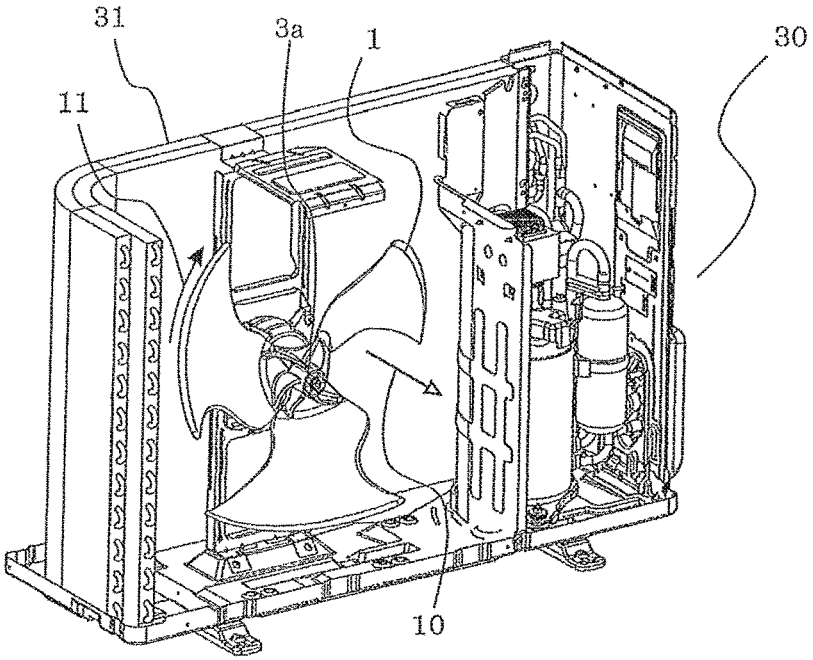
FIG. 16 is an internal perspective view in a case where the propeller fan according to any one of Embodiment 1 to Embodiment 3 is attached to the outdoor unit according to Embodiment 4.

FIG. 16 is an internal perspective view in a case where the propeller fan according to any one of Embodiment 1 to Embodiment 3 is attached to the outdoor unit according to Embodiment 4.

Figure 17:
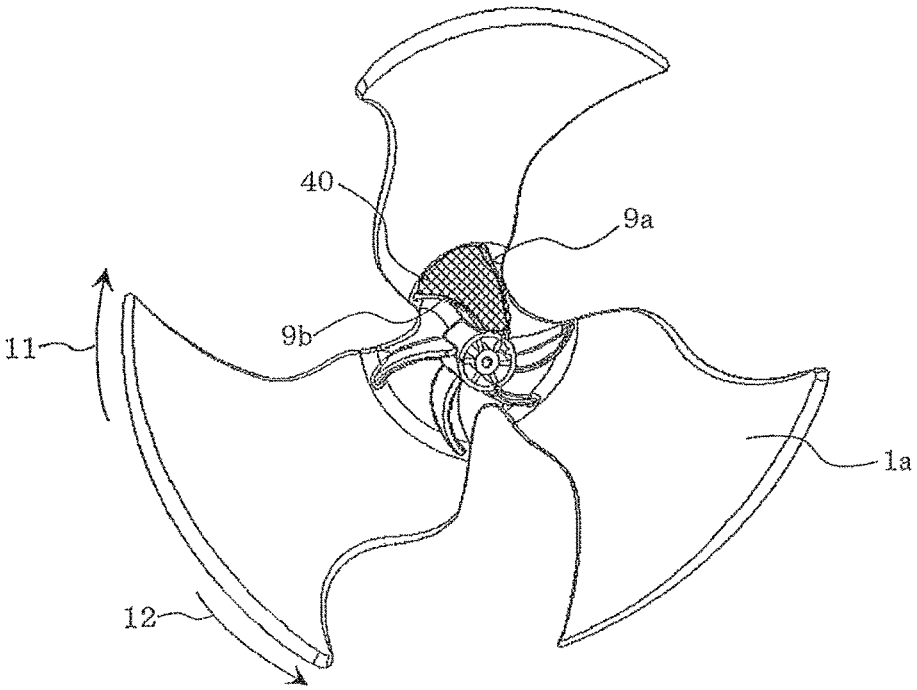
FIG. 17 illustrates the effects of reinforcement ribs when outdoor air strikes against the propeller fan in the outdoor unit according to Embodiment 4.

FIG. 17 illustrates the effects of the reinforcement ribs when outdoor air strikes against the propeller fan in the outdoor unit according to Embodiment 4.

When viewed from the front in the direction of the rotation axis 2*a*, each reinforcement rib 9 of the propeller fan in the outdoor unit 30 according to Embodiment 4 has a curved shape (i.e., turbo blade shape) convex toward the leading edge 6 of the propeller fan, as shown in FIG. 2.

As described in Embodiment 1, the reinforcement ribs 9 rotate in the normal rotational direction 11 to form a negative pressure region near the rotation axis 2*a*, thereby suctioning the reverse air current 21 relative to the outflow air current 20.

It is assumed that strong outdoor wind strikes against the propeller fan when the outdoor unit 30 according to Embodiment 3 is stopped. This strong wind acts on the propeller fan as head wind in the direction opposite to the fluid flowing direction 10 caused to occur during normal operation of the propeller fan.

The strong wind (i.e., head wind) collides against the pressure surfaces 1*a* of the propeller fan and causes the blades 1 to rotate in a counter rotational direction 12 opposite to the normal rotational direction 11. Then, the reinforcement ribs 9 with the curved shape (i.e., turbo blade shape) convexed in the rotational direction 11 in the case of the normal rotational direction 11 change into a curved shape (i.e., sirocco blade shape) concaved in the counter rotational direction 12 in the case of the counter rotational direction 12.

<Advantages>

When strong outdoor wind (i.e. head wind) strikes against the propeller fan provided in the outdoor unit 30, the propeller fan rotates at high speed, sometimes causing the blades 1 to fracture and break due to a centrifugal force.

In the propeller fan according to Embodiment 3, when strong wind strikes against the propeller fan, the reinforcement ribs 9 change into the curved shape (i.e., sirocco blade shape) concaved in the counter rotational direction 12, so that air in spaces 40 between the reinforcement ribs 9 shown in FIG. 15 acts as resistance against the rotation due to a parachute effect. Thus, in the normal rotational direction 11, the air-current suction effect according to Embodiment 1 is exhibited. Moreover, in the counter rotational direction 12 caused by strong wind, the rotational speed of the propeller fan is reduced, so that the propeller fan can be prevented from breaking.

<Packaging of Propeller Fan>

Packaging of the propeller fan according to any one of Embodiment 1 to Embodiment 3 will now be described.

Figure 18:
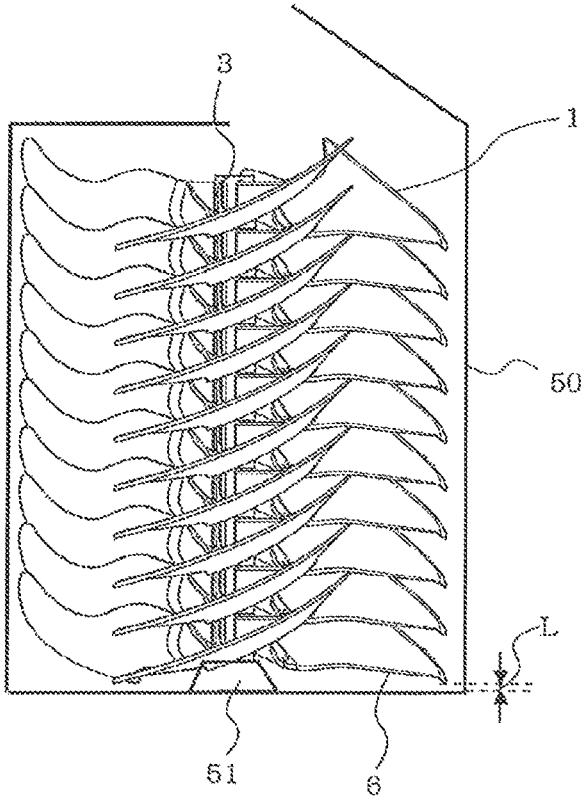
FIG. 18 schematically illustrates a packaged state of the propeller fan according to any one of Embodiment 1 to Embodiment 3.

FIG. 18 schematically illustrates a packaged state of the propeller fan according to any one of Embodiment 1 to Embodiment 3.

Figure 19:
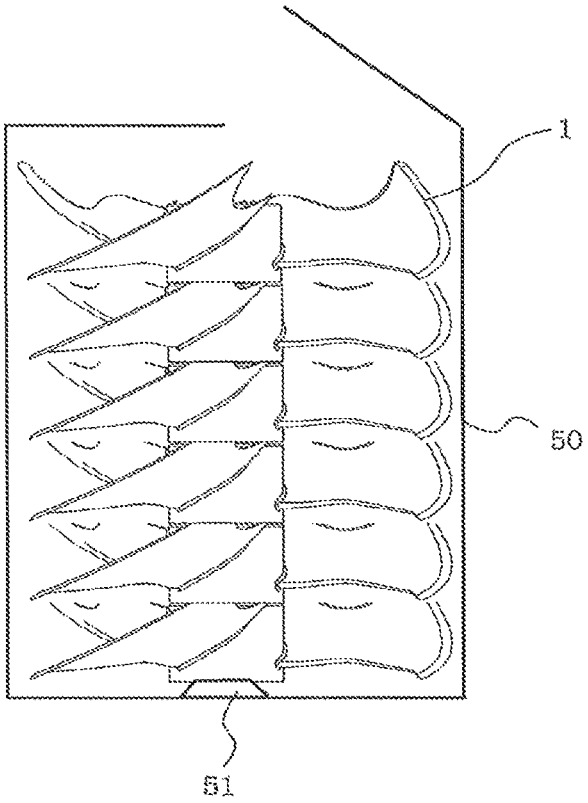
FIG. 19 RELATED ART
FIG. 19 schematically illustrates a packaged state of a boss-equipped propeller fan in the related art.
Figure 20:
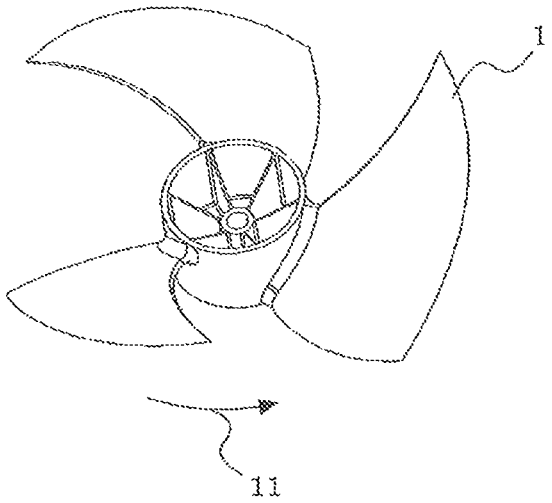
FIG. 20 RELATED ART
FIG. 20 is a perspective view of the boss-equipped axial flow fan in the related art.
Figure 21:
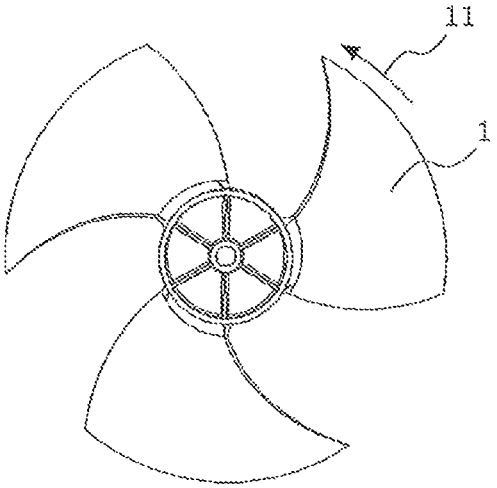
FIG. 21 RELATED ART
FIG. 21 is a front view of the boss-equipped axial flow fan in the related art, as viewed from upstream in the fluid flowing direction.
Figure 22:
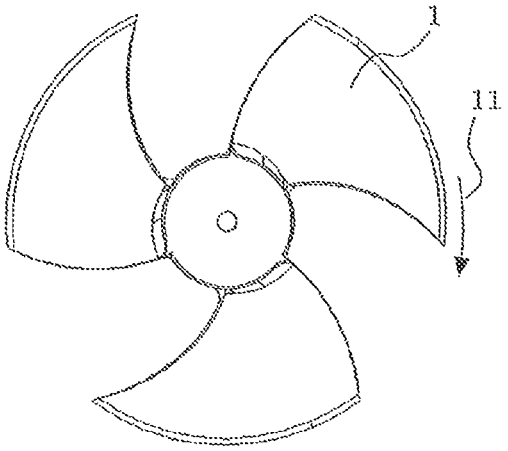
FIG. 22 RELATED ART
FIG. 22 is a front view of the boss-equipped axial flow fan in the related art, as viewed from downstream in the fluid flowing direction.
Figure 23:
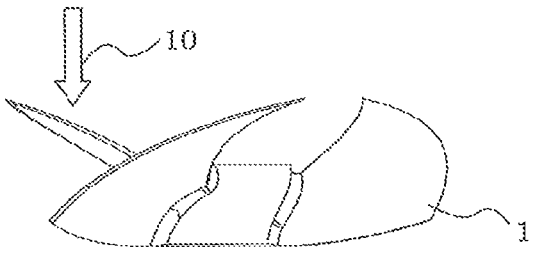
FIG. 23 RELATED ART
FIG. 23 is a side view of the boss-equipped axial flow fan in the related art, as viewed from a lateral side relative to a rotation axis.

FIG. 19 schematically illustrates a packaged state of the boss-equipped propeller fan in the related art.

In FIG. 18, boss-less propeller fans are stacked and contained within a packaging cardboard box 50, and a base 51 is disposed to support the bottom surface of the cylindrical portion 3 such that a distance L is ensured from the bottom surface of the cardboard box 50 to the leading edges 6 of the blades 1.

In the propeller fan according to any one of Embodiment 1 to Embodiment 3, the cylindrical portion 3 in the axial direction is shorter than the boss in the boss-equipped propeller fan in the related art in the direction of the rotation axis. Therefore, as shown in FIG. 18, the dimension in the stacking direction is reduced when the cylindrical portions 3 are stacked with their upper surfaces and lower surfaces in contact with each other, so that a larger number of propeller fans can be contained within the packaging cardboard box 50, as compared with the related art.

Embodiment 5

In the propeller fan according to any one of Embodiment 1 to Embodiment 4, two reinforcement ribs 9, that is, the upstream rib 9*a* and the downstream rib 9*b*, are provided for each blade 1. In Embodiment 5, only the downstream rib 9*b* of the two ribs, that is, the upstream rib 9*a* and the downstream rib 9*b*, is provided for each blade 1. Other components of the propeller fan are the same as those in Embodiment 1 to Embodiment 4.

Figure 42:
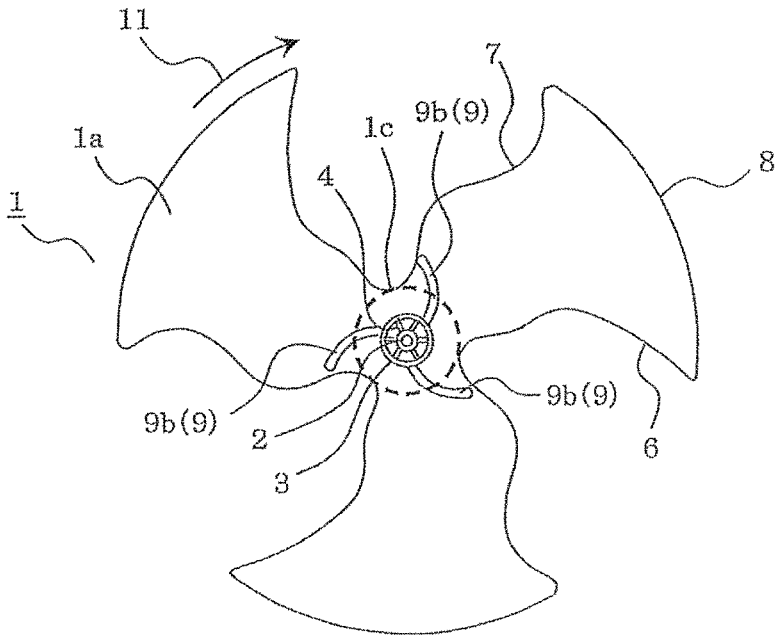
FIG. 42 is a front view of a propeller fan according to Embodiment 5, as viewed from downstream in the fluid flowing direction.

FIG. 42 is a front view of the propeller fan according to Embodiment 5, as viewed from downstream in the fluid flowing direction.

Figure 43:
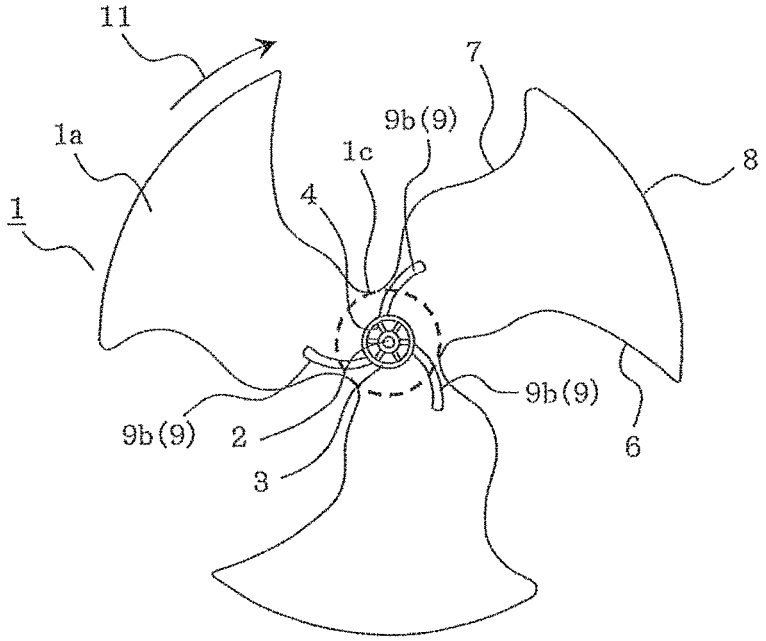
FIG. 43 is a front view of a propeller fan according to Modification 1 of Embodiment 5, as viewed from downstream in the fluid flowing direction.

FIG. 43 is a front view of a propeller fan according to Modification 1 of Embodiment 5, as viewed from downstream in the fluid flowing direction.

Figure 44:
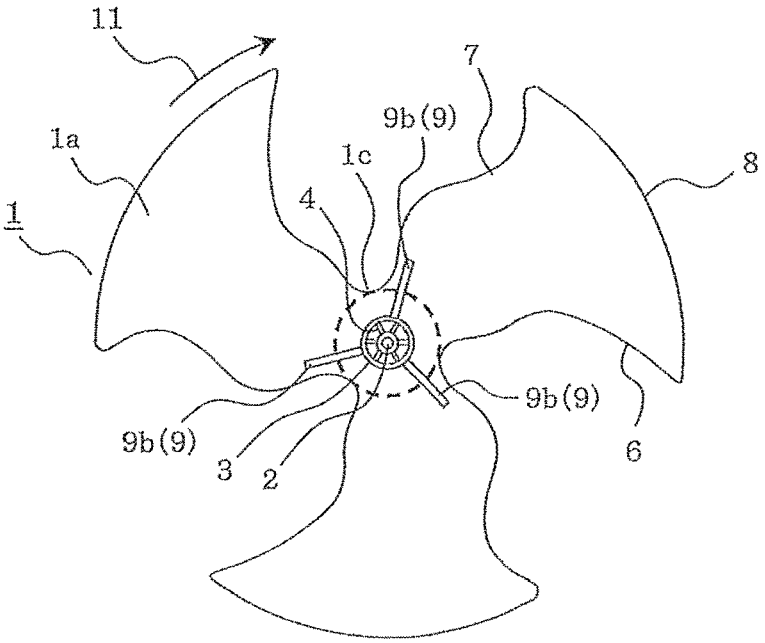
FIG. 44 is a front view of a propeller fan according to Modification 2 of Embodiment 5, as viewed from downstream in the fluid flowing direction.

FIG. 44 is a front view of a propeller fan according to Modification 2 of Embodiment 5, as viewed from downstream in the fluid flowing direction.

For example, as shown in FIG. 42, the propeller fan according to Embodiment 5 is provided with reinforcement ribs 9 having a turbo blade shape convex toward the leading edges 6 of the blades 1. Of the upstream ribs 9*a* and the downstream ribs 9*b* described in Embodiment 1 (see FIG. 2), the reinforcement ribs 9 only include the downstream ribs 9*b*.

<Modification 1>

Furthermore, for example, as shown in FIG. 43, the propeller fan according to Modification 1 of Embodiment 5 is provided with reinforcement ribs 9 having a sirocco blade shape convex toward the trailing edges 7 of the blades 1. Of the upstream ribs 9*a* and the downstream ribs 9*b* described in Embodiment 2 (see FIG. 10), the reinforcement ribs 9 only include the downstream ribs 9*b*.

<Modification 2>

Furthermore, for example, as shown in FIG. 44, the propeller fan according to Modification 2 of Embodiment 5 is provided with linear-flat-plate-shaped reinforcement ribs 9 extending radially from the rotation axis 2*a* of the propeller fan. Of the upstream ribs 9*a* and the downstream ribs 9*b* described in Modification 1 (see FIG. 9) of Embodiment 1, the reinforcement ribs 9 only include the downstream ribs 9*b*.

<Advantages>

In the propeller fan according to any one of Embodiment 5, Modification 1, and Modification 2 thereof, only a single downstream rib 9*b* is disposed for each blade 1 so that the propeller fan is reduced in weight. Moreover, the propeller fan according to Embodiment 5 is suitable for use in a low-speed rotation range and can maintain its strength even with the blades 1 being supported only by the downstream ribs 9*b*.

Furthermore, in the turbo-blade-shaped downstream ribs 9*b* and the radially-extending linear-flat-plate-shaped downstream ribs 9*b* according to Embodiment 5 and Modification 1 thereof, the effect of suctioning the reverse air current 21 near the rotation axis 2*a* can be exhibited. Thus, the wind velocity component Vz, in the direction of the rotation axis 2*a*, of the outflow air current 20 is relatively increased, whereby the air-blowing efficiency of the fan can be enhanced.

Moreover, with the sirocco-blade-shaped downstream ribs 9*b* according to Modification 2, the air pressed as a result of the rotation of the downstream ribs 9*b* is collected toward the rotation axis 2*a*, so that the effect of sending air in the direction of the rotation axis 2*a* is improved. In other words, an effect similar to a case where a mini propeller fan is provided at the center of each blade 1 is exhibited. Thus, the wind velocity component Vz in the direction of the rotation axis 2*a* is increased, whereby the air-blowing efficiency can be enhanced at the low-pressure-loss operating point.

Embodiment 6

In the propeller fan according to any one of Embodiment 1 to Embodiment 4, two reinforcement ribs 9, that is, the upstream rib 9*a* and the downstream rib 9*b*, are provided for each blade 1. In Embodiment 6, only the upstream rib 9*a* of the two ribs, that is, the upstream rib 9*a* and the downstream rib 9*b*, is provided for each blade 1. Other components of the propeller fan are the same as those in Embodiment 1 to Embodiment 4.

Figure 45:
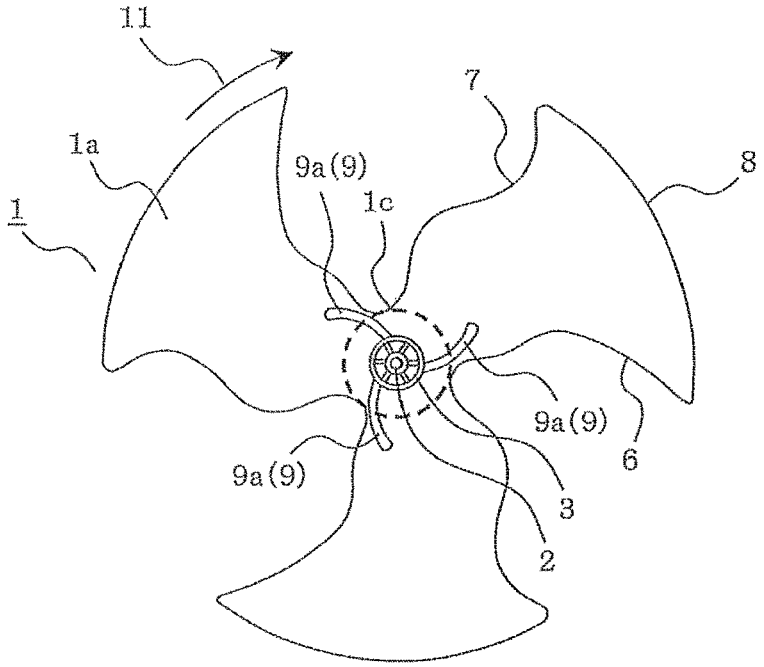
FIG. 45 is a front view of a propeller fan according to Embodiment 6, as viewed from downstream in the fluid flowing direction.

FIG. 45 is a front view of the propeller fan according to Embodiment 6, as viewed from downstream in the fluid flowing direction.

Figure 46:
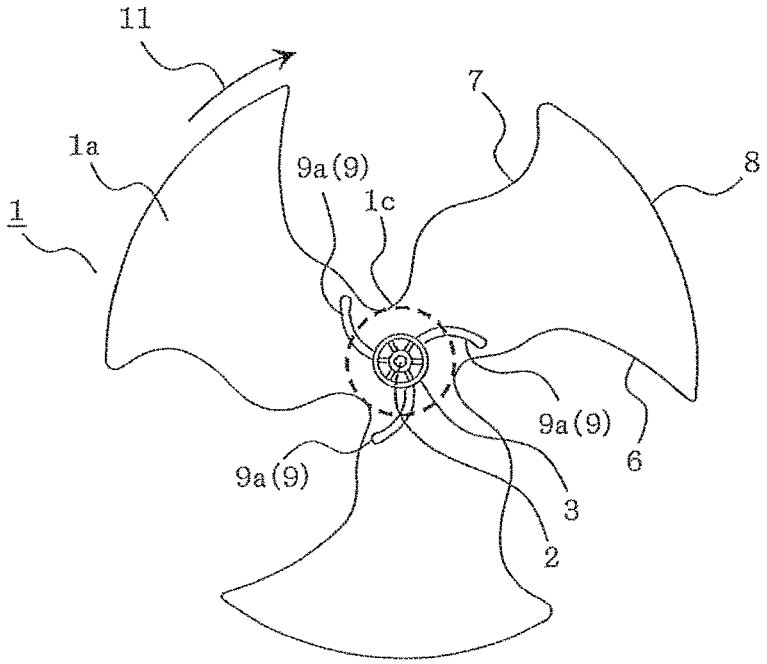
FIG. 46 is a front view of a propeller fan according to Modification 1 of Embodiment 6, as viewed from downstream in the fluid flowing direction.

FIG. 46 is a front view of a propeller fan according to Modification 1 of Embodiment 6, as viewed from downstream in the fluid flowing direction.

Figure 47:
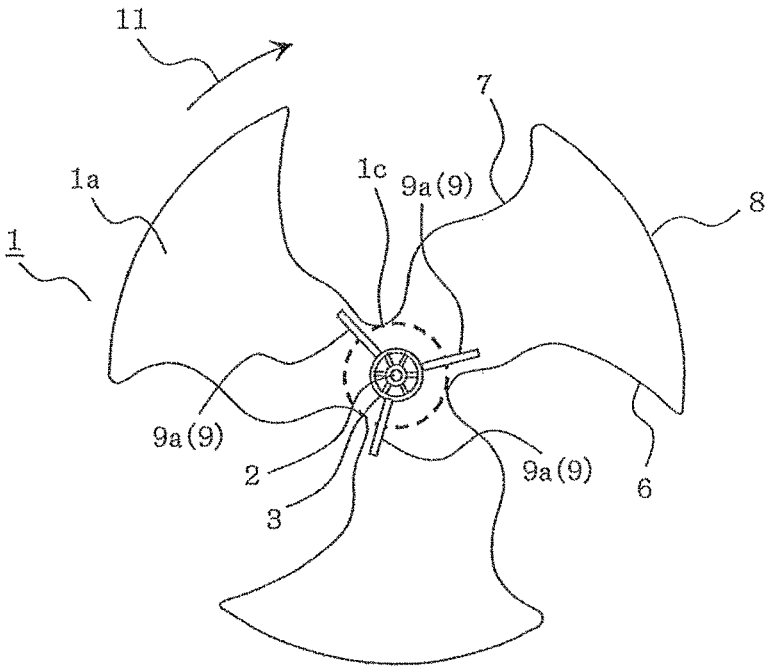
FIG. 47 is a front view of a propeller fan according to Modification 2 of Embodiment 6, as viewed from downstream in the fluid flowing direction.

FIG. 47 is a front view of a propeller fan according to Modification 2 of Embodiment 6, as viewed from downstream in the fluid flowing direction.

For example, as shown in FIG. 45, the propeller fan according to Embodiment 6 is provided with reinforcement ribs 9 having a turbo blade shape convex toward the leading edges 6 of the blades 1. Of the upstream ribs 9*a* and the downstream ribs 9*b* described in Embodiment 1 (see FIG. 2), the reinforcement ribs 9 only include the upstream ribs 9*a*.

<Modification 1>

Furthermore, for example, as shown in FIG. 46, the propeller fan according to Modification 1 of Embodiment 6 is provided with reinforcement ribs 9 having a sirocco blade shape convex toward the trailing edges 7 of the blades 1. Of the upstream ribs 9*a* and the downstream ribs 9*b* described in Embodiment 2 (see FIG. 10), the reinforcement ribs 9 only include the upstream ribs 9*a*.

<Modification 2>

Furthermore, for example, as shown in FIG. 47, the propeller fan according to Modification 2 of Embodiment 6 is provided with linear-flat-plate-shaped reinforcement ribs 9 extending radially from the rotation axis 2*a* of the propeller fan. Of the upstream ribs 9*a* and the downstream ribs 9*b* described in Modification 1 (see FIG. 9) of Embodiment 1, the reinforcement ribs 9 only include the upstream ribs 9*a*.

<Advantages>

In the propeller fan according to any one of Embodiment 6, Modification 1, and Modification 2 thereof, only a single upstream rib 9*a* is disposed for each blade 1 so that the propeller fan is reduced in weight. Moreover, as compared with the propeller fan according to Embodiment 3, the propeller fan according to Embodiment 6 is suitable for use in a high-speed rotation range and can maintain its strength due to the upstream ribs 9*a* being disposed at the leading edge 6 side where the stress on the blades 1 concentrates.

Furthermore, in the turbo-blade-shaped upstream ribs 9*a* and the radially-extending linear-flat-plate-shaped upstream ribs 9*a* according to Embodiment 6 and Modification 1 thereof, the effect of suctioning the reverse air current 21 near the rotation axis 2*a* can be exhibited. Thus, the wind velocity component Vz, in the direction of the rotation axis 2*a*, of the outflow air current 20 is relatively increased, whereby the air-blowing efficiency of the fan can be enhanced.

Moreover, with the sirocco-blade-shaped upstream ribs 9*a* according to Modification 2, the air pressed as a result of the rotation of the upstream ribs 9*a* is collected toward the rotation axis 2*a*, so that the effect of sending air in the direction of the rotation axis 2*a* is improved. In other words, an effect similar to a case where a mini propeller fan is provided at the center of each blade 1 is exhibited. Thus, the wind velocity component Vz in the direction of the rotation axis 2*a* is increased, whereby the air-blowing efficiency can be enhanced at the low-pressure-loss operating point.

Although one of the upstream rib 9*a* and the downstream rib 9*b* is disposed for each blade 1 in Embodiment 5 and Embodiment 6, the position where the single reinforcement rib 9 is disposed may be a freely-chosen position instead of a position near the leading edge 6 or the trailing edge 7 of the corresponding blade 1. In other words, the single reinforcement rib 9 may be disposed at a freely-chosen position so long as it is interposed between the leading edge 6 and the trailing edge 7 of the corresponding blade 1.

Embodiment 7

In the propeller fan according to any one of Embodiment 1 to Embodiment 6, the reinforcement ribs 9 used each have a flat plate shape with uniform thickness. Alternatively, each reinforcement rib 9 according to Embodiment 7 is provided with an expansion portion 60 having a large joint area with the corresponding blade 1 and located at the outer peripheral edge 8 side of the blade 1.

Other components of the propeller fan are the same as those in Embodiment 1 to Embodiment 6.

Figure 48:
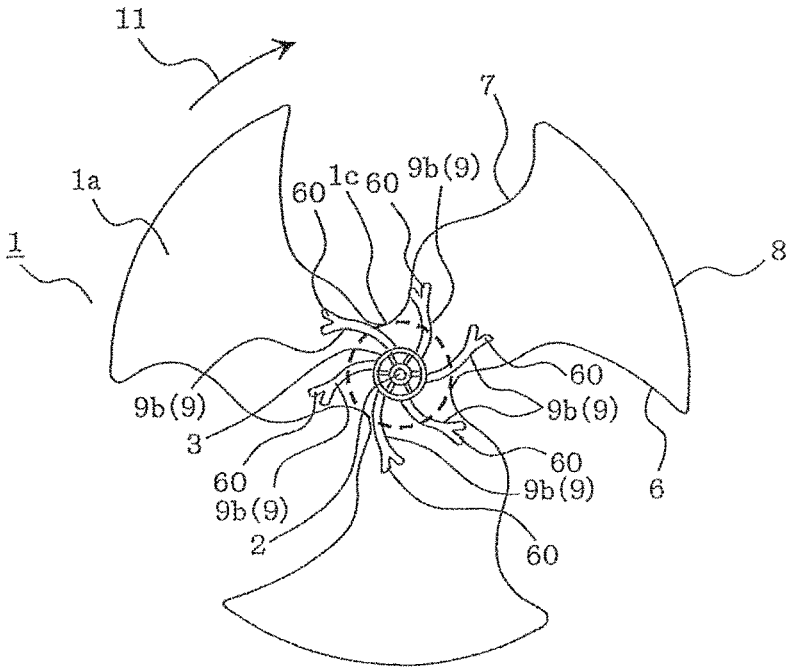
FIG. 48 is a front view of a propeller fan according to Embodiment 7, as viewed from downstream in the fluid flowing direction.

FIG. 48 is a front view of the propeller fan according to Embodiment 7, as viewed from downstream in the fluid flowing direction.

Figure 49:
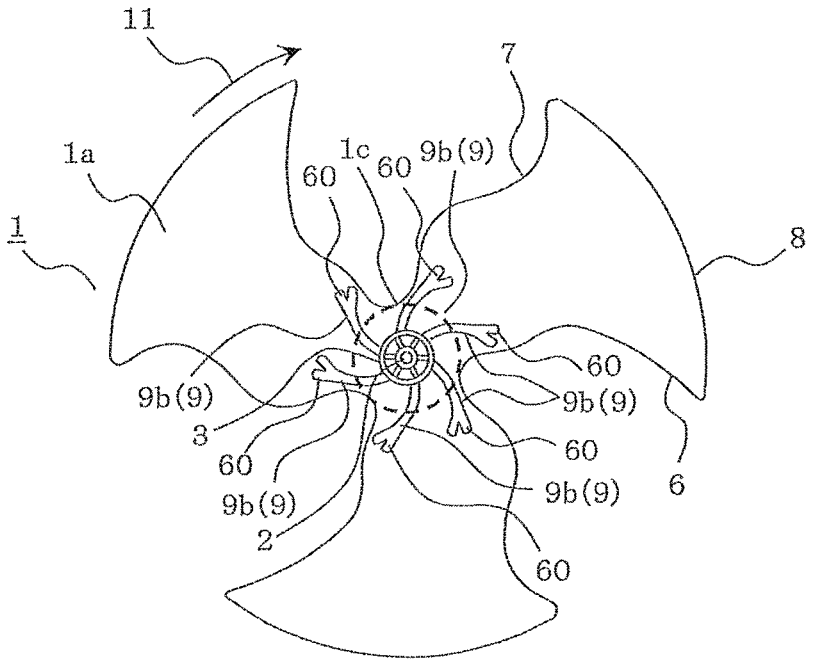
FIG. 49 is a front view of a propeller fan according to Modification 1 of Embodiment 7, as viewed from downstream in the fluid flowing direction.

FIG. 49 is a front view of a propeller fan according to Modification 1 of Embodiment 7, as viewed from downstream in the fluid flowing direction.

Figure 50:
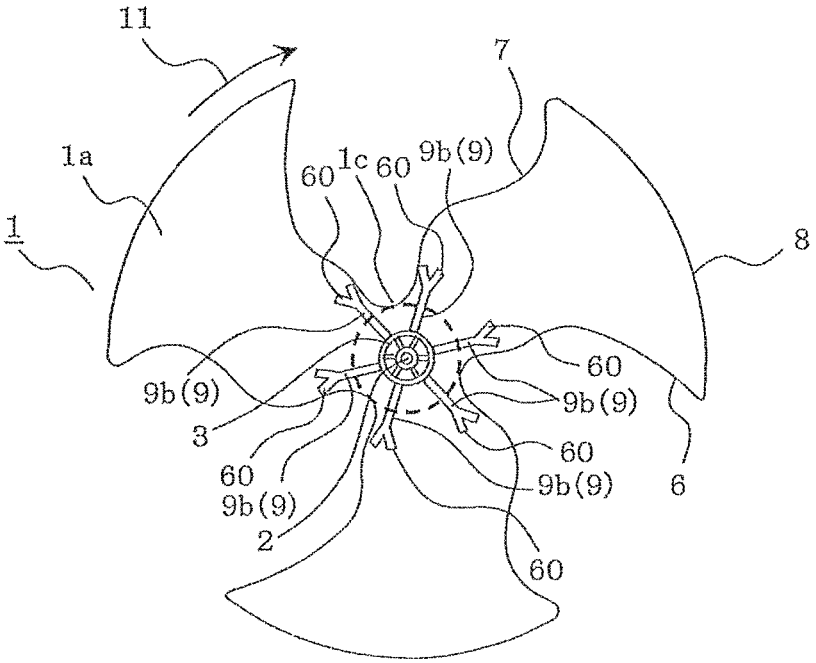
FIG. 50 is a front view of a propeller fan according to Modification 2 of Embodiment 7, as viewed from downstream in the fluid flowing direction.

FIG. 50 is a front view of a propeller fan according to Modification 2 of Embodiment 7, as viewed from downstream in the fluid flowing direction.

For example, as shown in FIG. 48, the propeller fan according to Embodiment 7 is provided with reinforcement ribs 9 having a turbo blade shape convex toward the leading edges 6 of the blades 1. As shown in FIG. 48, when viewed from the direction of the rotation axis 2*a*, the end at the outer peripheral edge 8 side of each reinforcement rib 9 is provided with an expansion portion 60 that expands in a Y shape in the thickness direction of the reinforcement rib 9. Specifically, the end at the outer peripheral edge 8 side of the reinforcement rib 9 is provided with the expansion portion 60 whose joint area with the corresponding blade 1 increases per unit length.

The shape of each expansion portion 60 is not limited to the Y shape shown in FIG. 48 so long as the end at the outer peripheral edge 8 side of the reinforcement rib 9 has a shape with which the joint area between the reinforcement rib 9 and the corresponding blade 1 increases. For example, the end at the outer peripheral edge 8 side of the reinforcement rib 9 may have a cylindrical shape or a polygonal columnar shape with an outer diameter larger than the thickness of the reinforcement rib 9. Specifically, when compared with the joint area between the blade 1 and the reinforcement rib 9 per unit length in the radial direction of the blade 1, the expansion portion 60 is defined as a section with a joint area larger than that of a portion other than the end at the outer peripheral edge 8 side of the reinforcement rib 9.

<Modification 1>

For example, as shown in FIG. 49, the propeller fan according to Modification 1 of Embodiment 7 is provided with reinforcement ribs 9 having a sirocco blade shape convex toward the trailing edges 7 of the blades 1. As shown in FIG. 49, when viewed from the direction of the rotation axis 2*a*, the end at the outer peripheral edge 8 side of each reinforcement rib 9 is provided with an expansion portion 60 that expands in a Y shape in the thickness direction of the reinforcement rib 9. Specifically, the end at the outer peripheral edge 8 side of the reinforcement rib 9 is provided with the expansion portion 60 whose joint area with the corresponding blade 1 increases per unit length. Similar to the above, the shape of the expansion portion 60 is not limited to the Y shape.

<Modification 2>

Furthermore, for example, as shown in FIG. 50, the propeller fan according to Modification 2 of Embodiment 7 is provided with linear-flat-plate-shaped reinforcement ribs 9 extending radially from the rotation axis 2*a* of the propeller fan. As shown in FIG. 50, when viewed from the direction of the rotation axis 2*a*, the end at the outer peripheral edge 8 side of each reinforcement rib 9 is provided with an expansion portion 60 that expands in a Y shape in the thickness direction of the reinforcement rib 9. Specifically, the end at the outer peripheral edge 8 side of the reinforcement rib 9 is provided with the expansion portion 60 whose joint area with the corresponding blade 1 increases per unit length.

Similar to the above, the shape of the expansion portion 60 is not limited to the Y shape.

<Advantages>

In the propeller fan according to any one of Embodiment 7, Modification 1, and Modification 2 thereof, each reinforcement rib 9 is provided with the expansion portion 60 whose joint area with the corresponding blade 1 increases at the outer peripheral edge 8 side of the blade 1. Thus, stress can be distributively received by the end at the outer peripheral edge 8 side of the reinforcement rib 9 where the stress acts on the blade 1 the most. Specifically, a large joint area with the blade 1 is ensured at the expansion portion 60, so that the reinforcement rib 9 can receive the stress from the blade 1 as a distributive load, thereby preventing the joint between the reinforcement rib 9 and the blade 1 from breaking. In particular, when strong outdoor wind strikes against the propeller fan in, for example, an outdoor unit and causes the propeller fan to rotate at high speed, the blades can be prevented from cracking.

Embodiment 8

With regard to the reinforcement ribs 9 according to any one of Embodiment 1 to Embodiment 7, the flat surfaces of the reinforcement ribs 9 are disposed parallel to the rotation axis 2*a* of the propeller fan. Alternatively, in a propeller fan according to Embodiment 8, the flat surfaces constituting the turbo-blade-shaped reinforcement ribs 9 are inclined such that the upper edges 9*ah* and 9*bh* thereof are inclined toward the leading edge 6 side.

Other components of the propeller fan are the same as those in Embodiment 1 to Embodiment 7.

Figure 51:
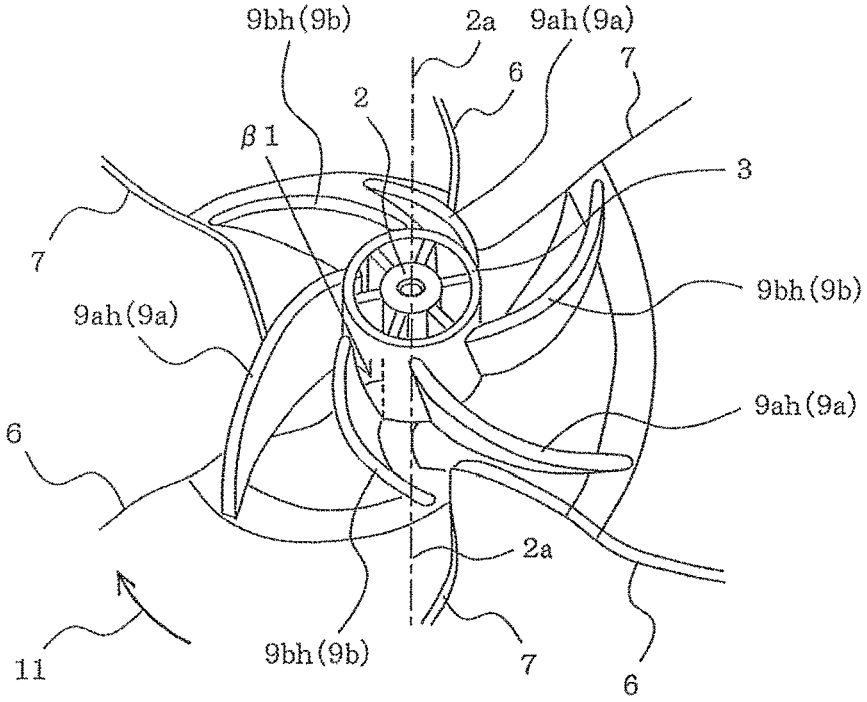
FIG. 51 is a partial perspective view of a propeller fan according to Embodiment 8, as viewed from downstream in the fluid flowing direction.

FIG. 51 is a partial perspective view of the propeller fan according to Embodiment 8, as viewed from downstream in the fluid flowing direction.

As shown in FIG. 51, each reinforcement rib 9 according to Embodiment 8 has a curved shape (i.e. turbo blade shape) convex toward the leading edge 6. Similar to Embodiment 1, the reinforcement ribs 9 include two ribs, that is, an upstream rib 9*a* and a downstream rib 9*b*. The flat surfaces constituting the reinforcement ribs 9 are inclined such that the upper edges 9*ah* and 9*bh* of the upstream rib 9*a* and the downstream rib 9*b* are inclined toward the leading edge 6 of the corresponding blade 1. An angle formed between the flat surface constituting each reinforcement rib 9 and the rotation axis 2*a* is β1, as shown in FIG. 51.

<Advantages>

In the propeller fan according to Embodiment 8, the turbo-blade-shaped reinforcement ribs 9 are inclined such that the upper edges 9*ah* and 9*bh* of the reinforcement ribs 9 are inclined toward the leading edge 6 side, whereby the effect of suctioning the reverse air current 21 near the rotation axis 2*a* can be further enhanced, as compared with an example in which the flat surfaces of the reinforcement ribs 9 are disposed parallel to the rotation axis 2*a*.

<Modification 1>

Next, Modification 1 of the reinforcement ribs 9 according to Embodiment 8 will be described with reference to FIG. 52.

Figure 52:
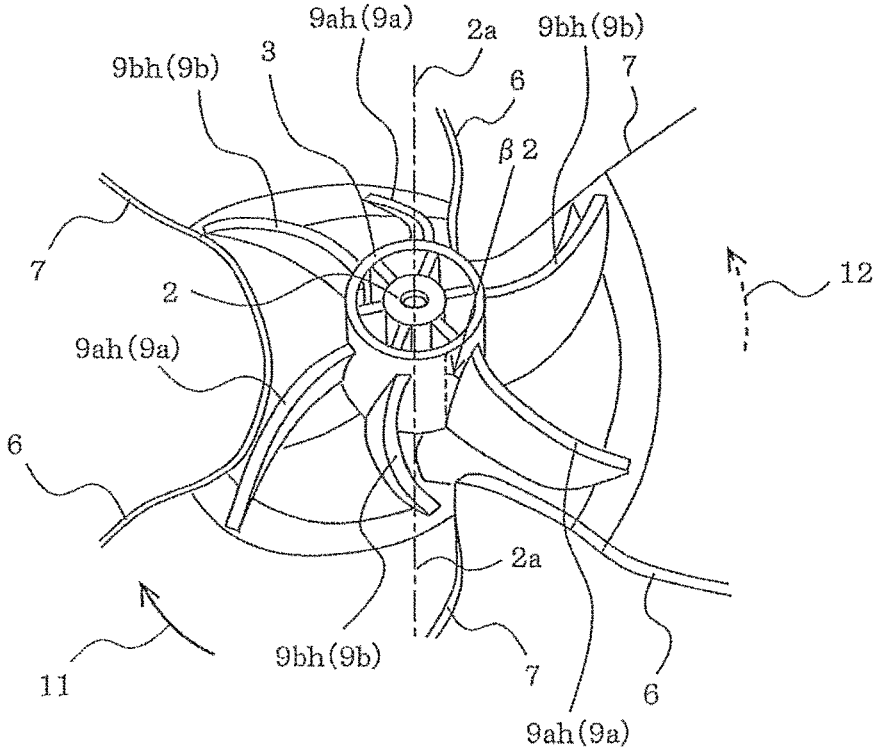
FIG. 52 is a partial perspective view of a propeller fan according to Modification 1 of Embodiment 8, as viewed from downstream in the fluid flowing direction.

FIG. 52 is a partial perspective view of a propeller fan according to Modification 1 of Embodiment 8, as viewed from downstream in the fluid flowing direction.

In Embodiment 8, the turbo-blade-shaped reinforcement ribs 9 are inclined such that the upper edges 9*ah* and 9*bh* of the reinforcement ribs 9 are inclined toward the leading edge 6 side. In Modification 1, the flat surfaces constituting the turbo-blade-shaped reinforcement ribs 9 are inclined such that the upper edges 9*ah* and 9*bh* thereof are inclined toward the trailing edge 7 side.

As shown in FIG. 52, each reinforcement rib 9 has a curved shape (i.e. turbo blade shape) convex toward the leading edge 6. Similar to Embodiment 1, the reinforcement ribs 9 include two ribs, that is, an upstream rib 9*a* and a downstream rib 9*b*. The flat surfaces constituting the reinforcement ribs 9 are inclined such that the upper edges 9*ah* and 9*bh* of the upstream rib 9*a* and the downstream rib 9*b* are inclined toward the trailing edge 7 of the corresponding blade 1. An angle formed between the flat surface constituting each reinforcement rib 9 and the rotation axis 2*a* is β2, as shown in FIG. 52.

<Advantages>

When strong outdoor wind during, for example, a typhoon strikes against the propeller fan according to Modification 1, the reinforcement ribs 9 change into a curved shape (i.e., sirocco blade shape) concaved in the counter rotational direction 12, so that the wind acts as resistance against the rotation due to a parachute effect. Thus, in the normal rotational direction 11, the air-current suction effect according to Embodiment 1 is exhibited. Moreover, in the counter rotational direction 12 caused by strong outdoor wind, the rotational speed of the propeller fan is reduced, so that the propeller fan can be prevented from breaking.

<Modification 2>

Next, Modification 2 of the reinforcement ribs 9 according to Embodiment 8 will be described with reference to FIG. 53.

Figure 53:
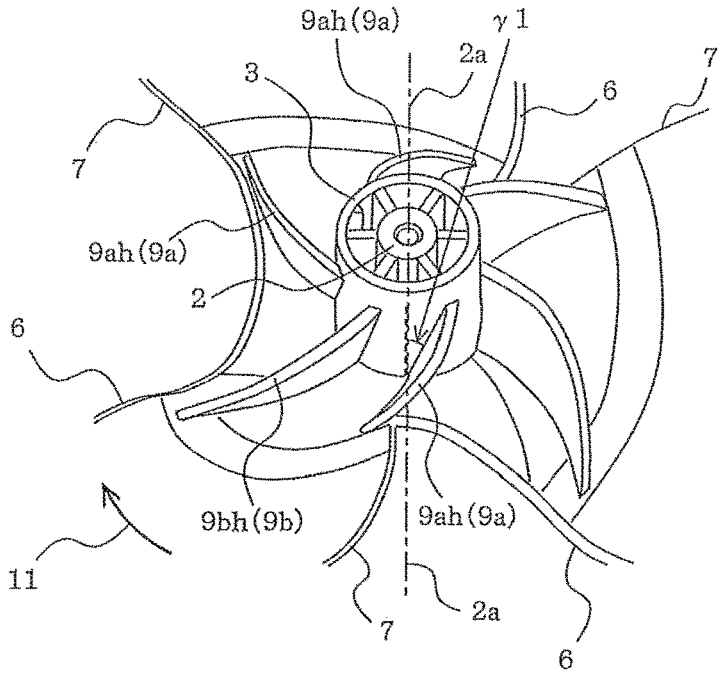
FIG. 53 is a partial perspective view of a propeller fan according to Modification 2 of Embodiment 8, as viewed from downstream in the fluid flowing direction.

FIG. 53 is a partial perspective view of a propeller fan according to Modification 2 of Embodiment 8, as viewed from downstream in the fluid flowing direction.

In Modification 1 of Embodiment 8, the turbo-blade-shaped reinforcement ribs 9 are inclined such that the upper edges 9*ah* and 9*bh* of the reinforcement ribs 9 are inclined toward the trailing edge 7 side. In Modification 2, the flat surfaces constituting sirocco-blade-shaped reinforcement ribs 9 are inclined such that the upper edges 9*ah* and 9*bh* thereof are inclined toward the trailing edge 7 side.

As shown in FIG. 53, each reinforcement rib 9 has a curved shape (i.e. sirocco blade shape) convex toward the trailing edge 7. Similar to Embodiment 1, the reinforcement ribs 9 include two ribs, that is, an upstream rib 9*a* and a downstream rib 9*b*. The flat surfaces constituting the reinforcement ribs 9 are inclined such that the upper edges 9*ah* and 9*bh* of the upstream rib 9*a* and the downstream rib 9*b* are inclined toward the trailing edge 7 of the corresponding blade 1. An angle formed between the flat surface constituting each reinforcement rib 9 and the rotation axis 2*a* is γ1, as shown in FIG. 53.

<Advantages>

In the propeller fan according to Modification 2, the sirocco-blade-shaped reinforcement ribs 9 are inclined such that the upper edges 9*ah* and 9*bh* of the reinforcement ribs 9 are inclined toward the trailing edge 7 side. Thus, a mini-propeller-fan effect by the reinforcement ribs 9 becomes larger so that the amount of air increases, as compared with an example in which the flat surfaces of the reinforcement ribs 9 are disposed parallel to the rotation axis 2*a* in accordance with Embodiment 2. Consequently, the wind velocity component Vz in the direction of the rotation axis 2*a* increases, whereby the air-blowing efficiency can be enhanced.

Embodiment 9

Although the reinforcement ribs 9 according to any one of Embodiment 1 to Embodiment 8 support the blades 1 beyond the circular minimum radius portion 1*d* having a radius defined by the shortest distance between the rotation axis 2*a* of the propeller fan and the peripheral edge of the connection portion 1*c*, each reinforcement rib 9 according to Embodiment 9 has a length defined within the minimum radius portion 1*d*.

Other components are the same as those in Embodiment 1 to Embodiment 8.

Figure 54:
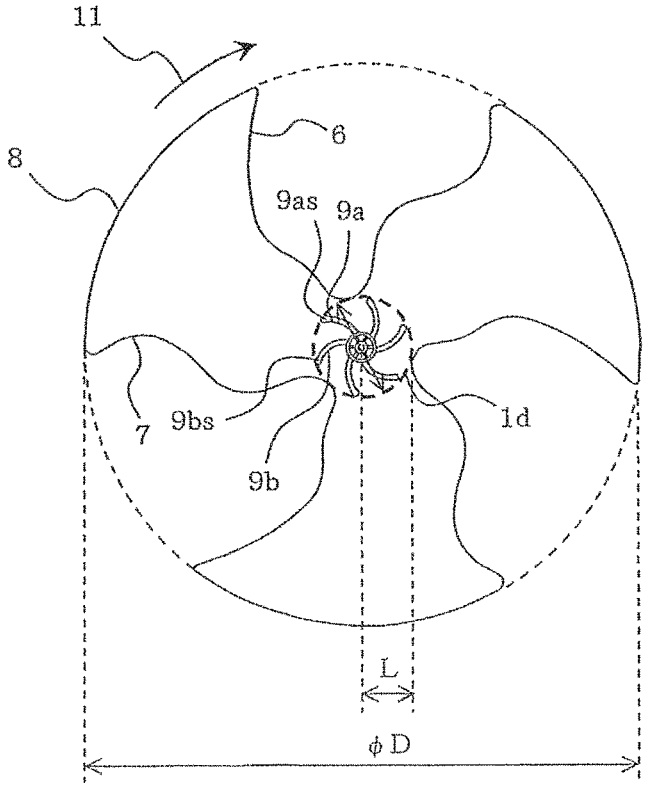
FIG. 54 is a front view of a propeller fan according to Embodiment 9, as viewed from downstream in the fluid flowing direction.

FIG. 54 is a front view of a propeller fan according to Embodiment 9, as viewed from downstream in the fluid flowing direction.

As shown in FIG. 54, the reinforcement ribs 9 according to Embodiment 9 are configured such that each turbo-blade-shaped reinforcement rib 9 has a length, in the radial direction, defined within the minimum radius portion 1*d*. Specifically, the length in the radial direction is smaller than that of each reinforcement rib 9 according to Embodiment 1.

In FIG. 54, assuming that the maximum outer diameter of each blade 1 of the propeller fan is defined as ϕD and the length of each reinforcement rib 9 in the radial direction is defined as L (i.e., the length between the rotation axis 2*a* and the upstream-rib contact point 9*as* or downstream-rib contact point 9*bs*), it is preferable that L be set such that the value of L/ϕD is between 0.025 and 0.1 inclusive.

<Advantages>

The propeller fan according to Embodiment 9 is suitable for use at the low-pressure-loss operating point where there is low flow-path resistance not requiring static pressure but requiring a certain amount of air between the normal operating point and the low-pressure-loss operating point in FIG. 11. Thus, since each reinforcement rib 9 is structurally defined to have a length within the minimum radius portion 1*d*, the propeller fan can be reduced in weight.

The blade shape of the propeller fan described above in any one of Embodiment 1 to Embodiment 9 can be applied to various air-blowing devices. For example, in addition to an outdoor unit of an air-conditioning apparatus, the blade shape can be applied to an air-blowing device of an indoor unit. Furthermore, the blade shape can be widely applied as a blade shape of a fluid-conveying axial-flow compressor, such as an air-blowing device, a ventilation fan, or a pump.

REFERENCE SIGNS LIST

1 blade 1*a* pressure surface 1*b* suction surface 1*c* connection portion 1*d* minimum radius portion 1*e* circular opening 2 shaft hole 2*a* rotation axis 2*b* axial portion 3 cylindrical portion 3*a* indicator 4 connection rib 6 leading edge 7 trailing edge 8 outer peripheral edge 9 reinforcement rib 9*a* upstream rib 9*ah* upper edge 9*as* upstream-rib contact point 9*b* downstream rib 9*bh* upper edge 9*bs* downstream-rib contact point 9*c* intermediate rib 9*c*1 first circular arc 9*c*2 second circular arc 10 fluid flowing direction parallel to rotation axis 11 rotational direction 12 counter rotational direction 15 center line 15*a* contact point 16 orthogonal plane 20 outflow air current 21 reverse air current 22 inflow air current 23 inverted air current 25 velocity component of rearward-inclined-type propeller fan 26 velocity component of forward-inclined-type propeller fan 30 outdoor unit 31 outdoor heat exchanger 40 space 50 cardboard box 51 base 60 expansion portion α1, α2 outflow angle β1, β2, γ1 angle of reinforcement rib

The invention claimed is:

1. An axial flow fan comprising a plurality of blades and being configured to rotate about a rotation axis of the blades to convey a fluid, the plurality of blades each having a leading edge at a leading side in a rotational direction, a trailing edge at a trailing side in the rotational direction, and an outer peripheral edge connecting the leading edge and the trailing edge, the leading edge of one of the plurality of blades and the trailing edge of another blade, adjacent to the one of the plurality of blades in the rotational directions, being connected by a plate-shaped connection portion, the plurality of blades each having at least one plate-shaped reinforcement rib extending from a periphery of the rotation axis toward the outer peripheral edge of the blade, and the reinforcement ribs being arc-shaped and bulging toward the leading edge, wherein:

the reinforcement ribs at least include an upstream rib and a downstream rib for each of the plurality of blades, the upstream rib being located at an upstream side in the rotational direction, the downstream rib being located at a downstream side in the rotational direction, when the blades rotate, the downstream ribs are configured to pass through a region through which the upstream ribs do not pass, and the upstream rib and the downstream rib are shaped such that an upper edge of the upstream rib is inclined relative to a direction of the rotation axis and an upper edge of the downstream rib is substantially orthogonal to the direction of the rotation axis.

2. The axial flow fan of claim 1, wherein the rotation axis is surrounded by a minimum radius portion having a radius defined by a shortest distance between the rotation axis and a peripheral edge of the connection portion, a cylindrical portion with the rotation axis as a central axis and having an outer radius smaller than the radius of the minimum radius portion is provided in the minimum radius portion, and the reinforcement ribs connect an outer peripheral surface of the cylindrical portion and the plurality of blades.

3. The axial flow fan of claim 1, wherein the reinforcement ribs provided at the plurality of blades intersect at the rotation axis to form an axial portion, and the reinforcement ribs connect the axial portion and the plurality of blades.

4. The axial flow fan of claim 1, wherein the rotation axis is surrounded by a minimum radius portion having a radius defined by a shortest distance between the rotation axis and a peripheral edge of the connection portion, a circular opening with the rotation axis as a central axis and having a radius smaller than the radius of the minimum radius portion is provided in the minimum radius portion, and the reinforcement ribs connect an opening edge of the circular opening and the plurality of blades.

5. The axial flow fan of claim 1, wherein an end of each reinforcement rib at a side of the outer peripheral edge is provided with an expansion portion having an increased area of joint, per unit length, with the corresponding blade.

6. The axial flow fan of claim 1, wherein:

the upstream rib and the downstream rib each have an upper edge at an end facing the corresponding blade, and an upstream-rib contact point serving as an intersection point between the blade and the upper edge of the upstream rib is located upstream in a conveying direction of the fluid relative to a downstream-rib contact point serving as an intersection point between the blade and the downstream rib.

7. The axial flow fan of claim 1, wherein:

each blade has a pressure surface, the pressure surface being on a downstream side of the fluid, and a suction surface located at a reverse side of the pressure surface, and each reinforcement rib is erectly provided on the pressure surface solely by mounting of a fluid upstream surface of the reinforcement rib on the pressure surface.

8. The axial flow fan of claim 1, wherein each reinforcement rib has an upper edge at an end facing the corresponding blade, and the upper edge of the reinforcement rib has a cross-sectional shape having a first circular arc and a second circular arc, the first circular arc being provided at an upstream side in the rotational direction, the second circular arc being provided at a downstream side in the rotational direction, and the first circular arc has a cross-sectional radius larger than a cross-sectional radius of the second circular arc.

9. The axial flow fan of claim 1, wherein the connection portion is inclined upstream in a conveying direction of the fluid from the leading edge of the neighboring blade toward the trailing edge.

10. The axial flow fan of claim 2, wherein each blade has a rearward-inclined shape in which a blade chord center line is located downstream, in a conveying direction of the fluid, of an orthogonal plane defined in a direction orthogonal to the rotation axis from a contact point where the blade chord center line of the blade is in contact with the outer peripheral surface of the cylindrical portion.

11. The axial flow fan of claim 2, wherein an indicator indicating a position where a drive shaft is to be secured within the cylindrical portion is provided between the reinforcement ribs at the outer peripheral surface of the cylindrical portion.

12. An air-conditioning apparatus comprising the axial flow fan of claim 1.

* * * * *